US011459740B2

(12) United States Patent
Stout

(10) Patent No.: US 11,459,740 B2
(45) Date of Patent: Oct. 4, 2022

(54) EASY DRAIN INSTALLATION ASSEMBLY FOR BATH OR SHOWER

(71) Applicant: Kohler Co., Kohler, WI (US)

(72) Inventor: Kenneth L. Stout, Sheboygan Falls, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 17/117,253

(22) Filed: Dec. 10, 2020

(65) Prior Publication Data

US 2021/0324617 A1 Oct. 21, 2021

Related U.S. Application Data

(60) Provisional application No. 63/011,842, filed on Apr. 17, 2020.

(51) Int. Cl.
*E03C 1/20* (2006.01)
*E03C 1/23* (2006.01)

(52) U.S. Cl.
CPC . *E03C 1/20* (2013.01); *E03C 1/23* (2013.01)

(58) Field of Classification Search
CPC ..... E03C 1/20; E03C 1/23
USPC ..... 4/679, 689, 286, 288
See application file for complete search history.

(56) References Cited

U.S. PATENT DOCUMENTS 982,836 A 1/1911 Ley
4,562,602 A * 1/1986 Cuschera ..... E03C 1/22 4/288
5,893,396 A 4/1999 Vagle
6,427,257 B1 8/2002 Castellote
7,503,082 B2 3/2009 Castellote
7,681,258 B2 3/2010 Ciechanowski et al.
7,682,562 B2 3/2010 Ciechanowski et al.
7,921,482 B2 4/2011 Shafik
8,683,622 B2 4/2014 Ciechanowski et al.
8,683,623 B2 4/2014 Ciechanowski et al.
9,114,060 B2 8/2015 Ciechanowski et al.
9,259,374 B2 2/2016 Castellote et al.
(Continued)

FOREIGN PATENT DOCUMENTS

CN 205369430 U 7/2016
JP 2004-300841 A 10/2004

OTHER PUBLICATIONS

First Chinese Office Action on CN Appl. Ser. No. 202110413871.6 dated Apr. 20, 2022 (28 pages).

*Primary Examiner* — Tuan N Nguyen
(74) *Attorney, Agent, or Firm* — Foley & Lardner LLP

(57) ABSTRACT

A drain assembly includes a drain body and an expanding assembly. The drain body defines an axis and includes a first flange extending away from an inner surface of the drain body toward the axis and a second flange extending away from the inner surface of the drain body toward the axis. The expanding assembly is positionable within the drain body between the first flange and the second flange. The expanding assembly includes a lattice body and a fastener. The lattice body is positionable between the first flange and the second flange and a portion of the lattice body defines an aperture extending therethrough. The fastener is adjustably coupled to the lattice body at the aperture. The fastener is configured to be adjusted relative to the lattice body such that the expanding assembly applies an axial force to the first flange and the second flange.

20 Claims, 18 Drawing Sheets

(56) References Cited

U.S. PATENT DOCUMENTS

| | | | | |
|---|---|---|---|---|
| 9,551,138 | B2 | 1/2017 | McLeod et al. | |
| 10,385,557 | B2 | 8/2019 | McLeod et al. | |
| 10,465,370 | B2 | 11/2019 | Donnelly | |
| 2005/0217016 | A1 | 10/2005 | Ciechanowski et al. | |
| 2009/0007329 | A1* | 1/2009 | Hackett | E03C 1/232 4/679 |
| 2015/0314248 | A1 | 11/2015 | Castellote et al. | |
| 2017/0005849 | A1 | 1/2017 | Hang et al. | |
| 2017/0058498 | A1 | 3/2017 | Castellote | |
| 2017/0260723 | A1* | 9/2017 | Zhou | E03C 1/23 |
| 2018/0045344 | A1 | 2/2018 | Cloutier | |
| 2021/0002876 | A1 | 1/2021 | McAlpine et al. | |
| 2021/0047816 | A1 | 2/2021 | Pilarczyk | |

* cited by examiner

EASY DRAIN INSTALLATION ASSEMBLY FOR BATH OR SHOWER

CROSS REFERENCE TO RELATED APPLICATIONS

This application claims the benefit of and priority to U.S. Provisional Application No. 63/011,842, filed on Apr. 17, 2020, the entire disclosure of which is hereby incorporated by reference herein.

BACKGROUND

The present application relates generally to the field of bath and shower drain installation assemblies.

When a person is installing a bathtub, that person may need access to the underside of the bathtub in order to install the drain to/in the drain opening of the bathtub. Once installed, the drain may project from the underside of the bathtub. The bathtub then would be lifted up, the drain opening lined up with a drain pipe in the floor, and then slid onto or over the drain pipe. This installation process can be difficult for a single person to do on their own. And if the bathtub is heavy, such as for an iron stand-alone bathtub, more than two people may be required to lift the bathtub.

Accordingly, it may be desirable to use a drain that can be installed entirely from the top-side of the bathtub (e.g., without requiring access to the underside of the bathtub.)

SUMMARY

According to an exemplary embodiment, a drain assembly is provided. The drain assembly includes a drain body defining an axis and an expanding assembly. The drain body includes a drain body and an expanding assembly. The drain body defines an axis and includes a first flange extending away from an inner surface of the drain body toward the axis and a second flange extending away from the inner surface of the drain body toward the axis. The expanding assembly is positionable within the drain body between the first flange and the second flange. The expanding assembly includes a lattice body and a fastener. The lattice body is positionable between the first flange and the second flange and a portion of the lattice body defines an aperture extending therethrough. The fastener is adjustably coupled to the lattice body at the aperture. The fastener is configured to be adjusted relative to the lattice body such that the expanding assembly applies an axial force to the first flange and the second flange.

According to another exemplary embodiment, a drain assembly is provided. The drain assembly includes a drain body, an expanding assembly, and a tailpiece. The drain body includes an inner surface that defines a central axis where the inner surface further defines a body diameter. The drain body also includes a first flange and a second flange. The first flange extends inwardly toward the central axis and defining a first diameter less than the body diameter. The second flange extends inwardly toward the central axis and defines a second diameter less than the first diameter. The expanding assembly is positioned between the first flange and the second flange. The expanding assembly is configured to apply a force to both the first flange and the second flange in opposite directions. The tailpiece includes a tailpiece flange which defines a flange diameter greater than the second diameter and less than the first diameter. The tailpiece flange is biased toward the second flange when the expanding assembly applies the force between the first flange and the second flange.

According to another exemplary embodiment, a drain assembly is provided. The drain assembly includes a drain body and an expanding assembly. The drain body includes an inner surface defining a groove that extends circumferentially about the drain body and a body flange extending away from the inner surface of the drain body toward a central axis. The expanding assembly is positionable within the groove. The expanding assembly includes a lattice body and a fastener. The lattice body includes a lug extending radially away from the lattice body in a direction generally away from the central axis and the lattice body defines an aperture therethrough proximate to the lug. The fastener is adjustably coupled to the lattice body and is configured to extend through the aperture.

This summary is illustrative only and should not be regarded as limiting.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

It will be recognized that some or all of the Figures are schematic representations for purposes of illustration. The Figures are provided for the purpose of illustrating one or more implementations with the explicit understanding that they will not be used to limit the scope or the meaning of the claims.

DETAILED DESCRIPTION

Referring generally to the FIGURES, an easy drain installation assembly is shown according to various exemplary embodiments. The easy drain installation assembly is structured to couple a drain opening in a wash basin to a drain pipe in a floor without requiring access to the underside of the wash basin. This may allow an installer of the wash basin to install the easy drain installation assembly without having to lift the wash basin off the floor. Instead, the installer may slide the wash basin over the drain pipe in the floor and line up the drain pipe with the drain opening in the wash basin. Doing so may save time and avoid injury.

Figure 1:
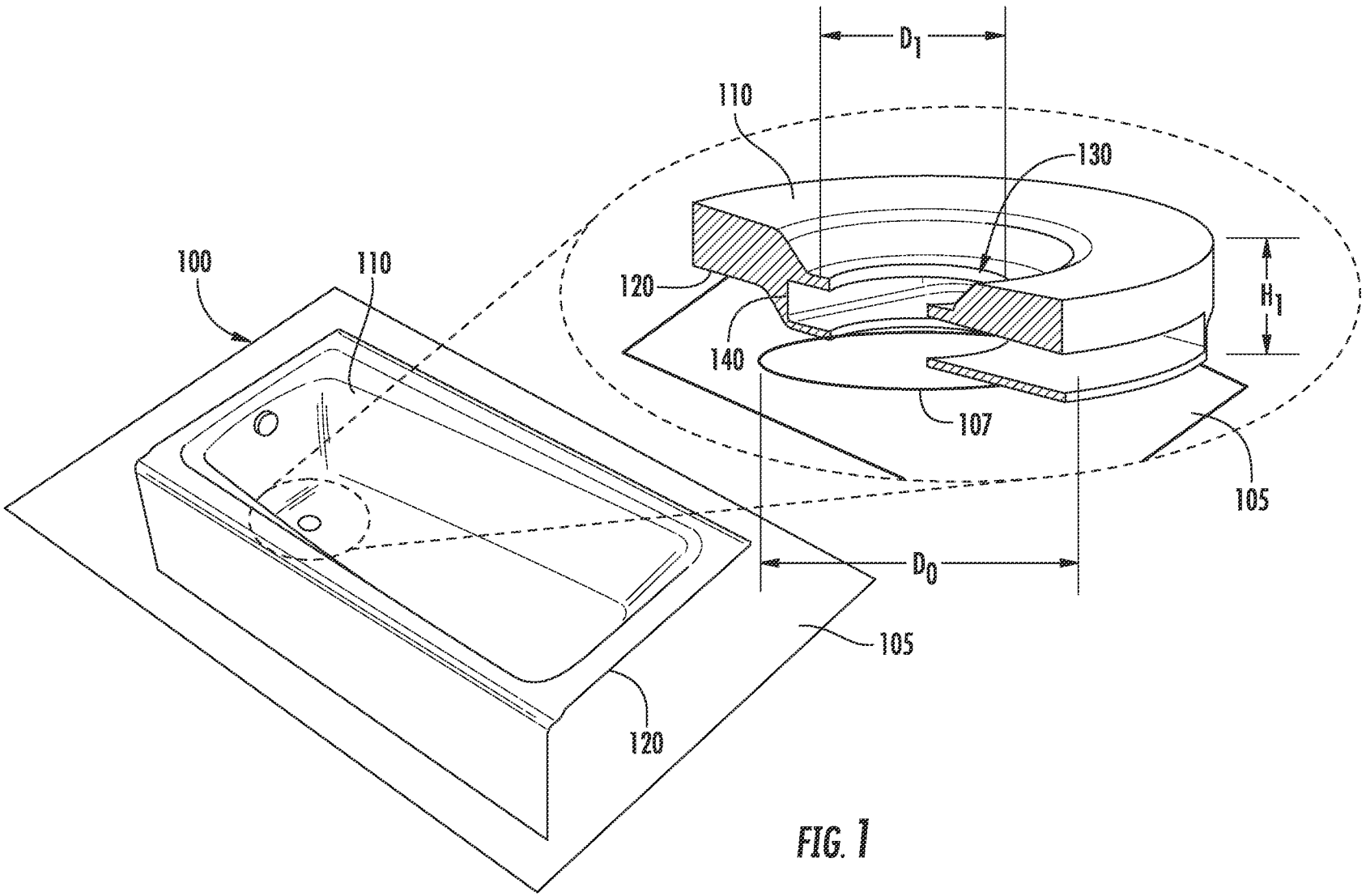
FIG. 1 shows a wash basin according to an example embodiment.

Referring to FIG. 1, a wash basin (e.g., tub, bathtub, basin, bath, sink, shower, shower floor, etc.) 100 is shown according to an exemplary embodiment. The wash basin 100 may be tiled, poured cement, metal, plastic, porcelain, acrylic, acrylic resin, fiberglass, reinforced fiber cloth, polyester, vitreous enamel, cast iron, porcelain enameled steel, stone, stone resin, or similar products and composites. The wash basin 100 rests on a floor (e.g., subfloor, ground, surface, etc.) 105. The floor 105 includes a floor opening (e.g., hole, cut-out, orifice, etc.) 107 through which drain plumbing may extend. The floor opening 107 is defined by a floor opening diameter $D_0$. The wash basin 100 is configured to receive a flow of water from a faucet (e.g., shower, shower head, spray head, spout, etc.). The wash basin 100 has a top (e.g., inner, first, etc.) basin surface 110 and a bottom (e.g., outer, second, etc.) basin surface 120. The top basin surface 110 and the bottom basin surface 120 are separated from one another by a thickness of the wash basin 100 shown as a basin thickness $H_1$. Portions of the top basin surface 110 and the bottom basin surface 120 may be substantially parallel to one another. The top basin surface 110 may be shaped into a cavity configured to hold water. The top basin surface 110 is resistant to water corrosion (e.g., warping, rusting, dissolving, etc.) and may be manufactured from plastic, fiberglass, stone, stone resin, porcelain, or various other suitable surfaces. Extending through both the top basin surface 110 and the bottom basin surface 120 is a drain opening (e.g., orifice, hole, opening, drain, etc.) 130. The drain opening 130 has a drain opening diameter $D_1$ proximate to both the top basin surface 110 and the bottom basin surface 120. The top basin surface 110 may be configured to direct a flow of water from the faucet toward the drain opening 130. A portion of the top basin surface 110 proximate to the drain opening 130 may be recessed (e.g., depressed, sunken, funneled, etc.) to aid in directing a flow of water from the wash basin 100 toward the drain opening 130. The drain opening 130 is configured to accept a drain assembly, such as an easy drain installation assembly 200 as shown in FIG. 2.

Disposed between the top basin surface 110 and the bottom basin surface 120, proximate to the drain opening 130, may be a cavity (e.g., channel, aperture, etc.), shown as an overflow channel 140.

Figure 2:
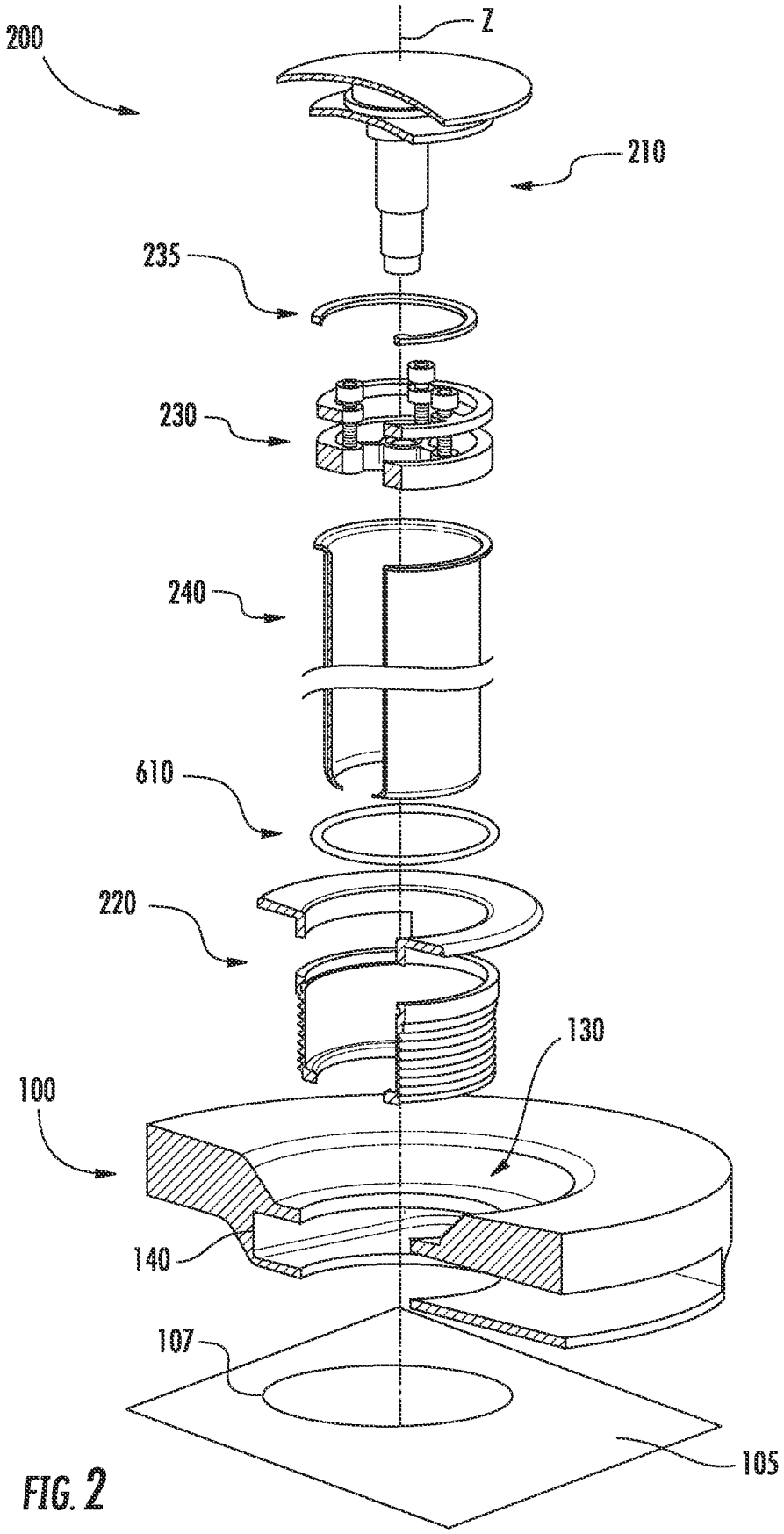
FIG. 2 shows an exploded view of an easy drain installation assembly according to an example embodiment.

Referring to FIG. 2, an exploded view of the easy drain installation assembly 200 is shown, according to an example embodiment. The easy drain installation assembly 200 includes a drain body 220, an expanding assembly 230, and a retaining ring 235. The expanding assembly 230 is configured to be received within and coupled to the drain body 220. In some embodiments, the easy drain installation assembly 200 includes the drain body 220, the expanding assembly 230, the retaining ring 235, and a toe tap 210. The toe tap (e.g., stopper, plug, drain plug, toe touch, foot actuated stopper) 210 may be any variety of drain stopper, including a lift-and-turn stopper, push-and-pull stopper, flip-it stopper, trip lever stopper, pop-up stopper, or similar drain plug or stopper. The toe tap 210 is configured to be disposed within and received by the drain body 220. When the expanding assembly 230 is disposed within the drain body 220, the toe tap 210 may be received within the drain body 220 and removably coupled to (e.g., threadingly coupled to, etc.) the expanding assembly 230. A portion of the toe tap 210 extends out of the drain body 220. The drain body 220 and the toe tap 210 are configured to cooperate to selectively prevent a flow of water, such as from the wash basin 100, through the drain body 220.

Further configured to be received by the drain body 220 may be a generally cylindrical conduit, shown as a tailpiece 240. The tailpiece 240 may be similar to a tailpiece that is included with the DROP-IN DRAIN™ (herein "Drop-In Drain"), distributed by CG Air Systems Inc. Generally speaking, the Drop-In Drain includes a fixture configured to be coupled to the subfloor (e.g., the floor 105) and in fluid communication with a P-trap or other drainage plumbing positioned below the subfloor. The tailpiece (e.g., the tailpiece 240) is configured to be coupled to the wash basin 100 prior to the tailpiece being inserted into the fixture. Once the tailpiece is coupled to the wash basin 100, the wash basin 100 is lifted off the ground, the tailpiece is aligned with the fixture, and the wash basin 100 is then lowered onto the floor as the tailpiece extends into the fixture, forming a seal between the tailpiece and the fixture. This method has the disadvantage of requiring the wash basin 100 to be lifted off the ground. The present application discloses an easy drain installation assembly that may be used with (e.g., compatible with, etc.) the Drop-In Drain presently commercially available. The easy drain installation assembly 200 provides the advantage of allowing the tailpiece from the Drop-In Drain to be inserted into the drain opening 130 in the wash basin 100 from within the wash basin 100 (e.g., from the top basin surface 110). This avoids the need to lift the wash basin 100 off the ground to align and insert the tailpiece 240 into the floor opening 107 (e.g., the fixture provided with the Drop-In Drain). Further, the easy drain installation assembly 200 may avoid damage to the tailpiece 240 and the Drop-In Drain caused by large moment forces applied to the tailpiece 240. When installing the tailpiece 240 of the easy drain installation assembly 200, the installer has an increased "feel" for the alignment of the drain opening 130 relative to the floor opening 107. In some embodiments, the tailpiece 240 has very little inertia compared to the wash basin 100, and thus if the drain opening 130 is misaligned with (e.g., not exactly concentric with) the floor opening 107, the installer will feel an increased resistance (e.g., relative to a perfectly aligned drain opening 130) when installing the tailpiece 240 into the fixture, caused by a bending moment within the tailpiece 240, cooperatively applied by the fixture and the drain opening 130. If the installer believes there is too much resistance when installing the tailpiece 240, the installer may micro-adjust the alignment of the drain opening 130 with the floor opening 107, testing the resistance iteratively until the installer feels comfortable that the resistance felt by installing the tailpiece 240 into the fixture matches the manufactures intentions and suggestions. By decreasing or eliminating the bending moment applied on the tailpiece 240, the longevity of the easy drain installation assembly 200 is improved, as the wear on the sealing components (e.g., nuts, rubber gaskets, washers, etc.) is decreased throughout the useful lifetime of the easy drain installation assembly 200.

In contrast, when the tailpiece 240 is installed on (e.g., coupled to) the wash basin 100 prior to the wash basin 100 being placed on the floor 105, the inertia of the wash basin 100 dampens the 'feel' the installer has, as outlined above. Thus, larger bending moments may be applied (albeit inadvertently) to the tailpiece 240, increasing the pressure on the sealing components and causing the sealing components to fail more quickly than intended by the manufacturer. While it is still possible, in some embodiments, to install the tailpiece 240 and the easy drain installation assembly 200 to the wash basin 100 prior to placing the wash basin 100 on the floor 105, there are advantages to installing the tailpiece 240 to the wash basin 100 after the wash basin 100 is positioned on the floor 105 and the drain opening 130 and the floor opening 107 are appropriately aligned.

Figure 4:
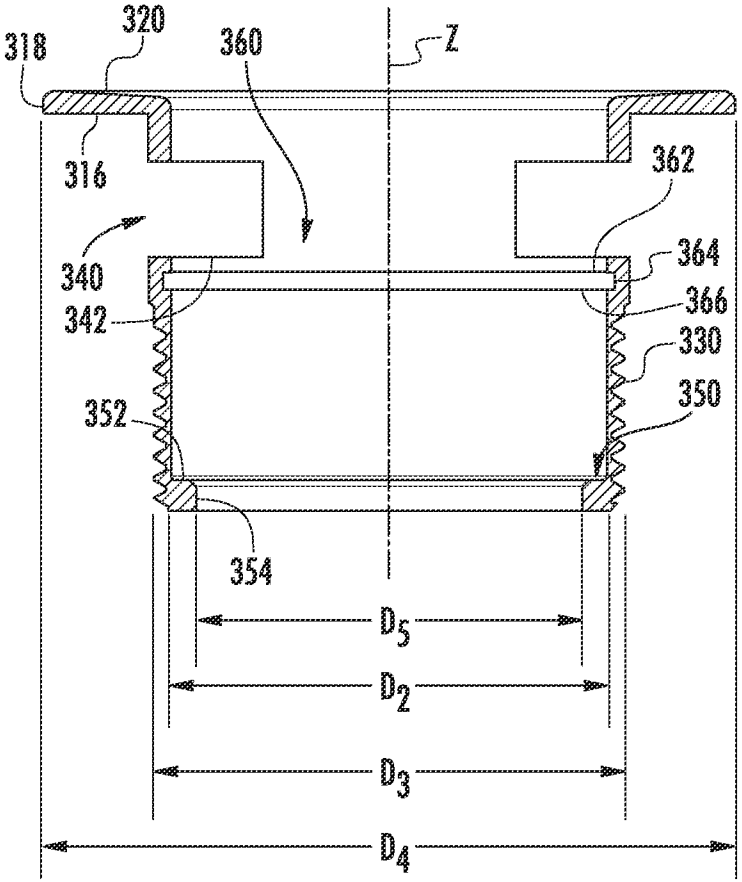
FIG. 4 shows a side, cross-section view of the portion of the easy drain installation assembly of FIG. 3.
Figure 3:
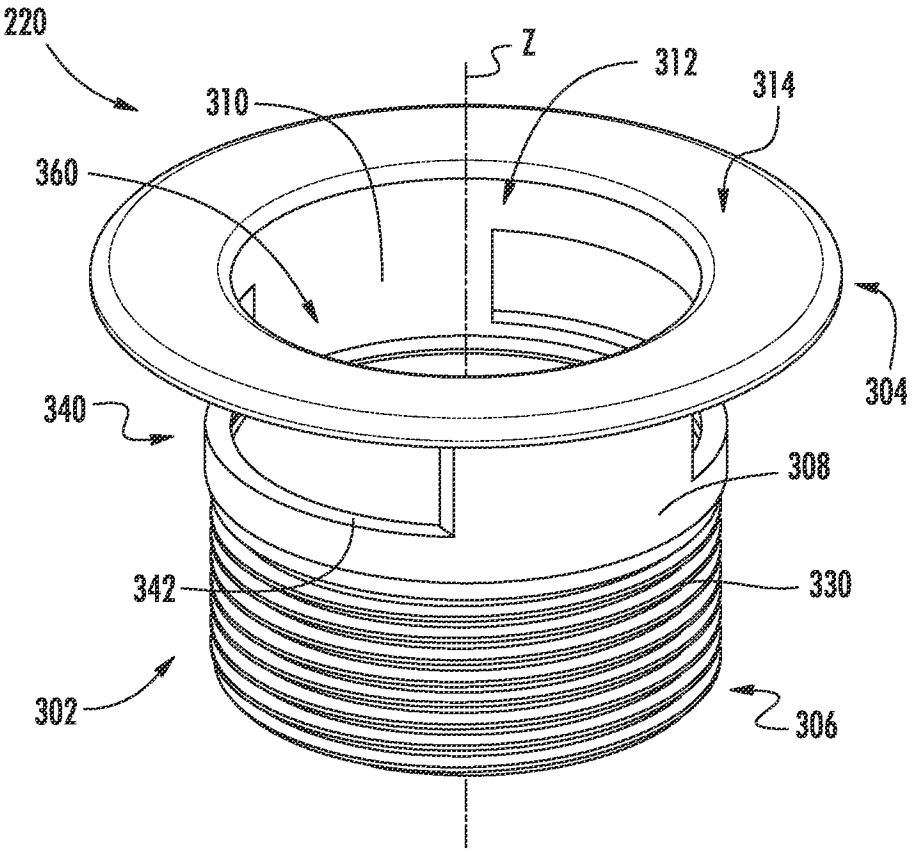
FIG. 3 shows a perspective view of a portion of the easy drain installation assembly of FIG. 2.

Turning to FIGS. 3 and 4, an exemplary embodiment of the drain body 220 is shown. The drain body 220 includes a generally annular first body 302 having a first upper end 304, a first lower end 306, a first outer surface 308, and a first inner surface 310. The first outer surface 308 and the first inner surface 310 may be concentric about the center axis Z. The first inner surface 310 defines a drain body opening 312 having a second diameter $D_2$ proximate to the first lower end 306. The drain body opening 312 may maintain a circular cross-section of the second diameter $D_2$ extending between the first upper end 304 and the first lower end 306. The first outer surface 308 maintains a circular cross-section of a third diameter $D_3$ extending between the first upper end 304 and the first lower end 306. The third diameter $D_3$ may be less than the drain opening diameter $D_1$ such that the drain body 220 may extend into the drain opening 130.

The drain body 220 further includes a generally annular flange, shown as a first flange 314 extending laterally outwardly from (e.g., orthogonal to) the first outer surface 308. As shown in FIG. 4, the first flange 314 extends outwardly from the first upper end 304. In some embodiments, the first flange 314 may extend from the first outer surface 308 at other heights such that a portion of the first body 302 extends above the first flange 314 (e.g., between the first flange 314 and the first upper end 304.) The first flange 314 defines a fourth diameter $D_4$. The fourth diameter $D_4$ may be greater than the drain opening diameter $D_1$ such that the first flange 314 may prevent the drain body 220 from falling completely through the drain opening 130 during installation.

The first flange 314 includes a first flange first surface 316, a first flange second surface 318, and a first flange third surface 320. The first flange first surface 316 is contiguous with and concentric about the first outer surface 308. In some embodiments, the first flange first surface 316 is perpendicular to the first outer surface 308. In other embodiments, the first flange first surface 316 meets the first outer surface 308 at an angle other than perpendicular. In some embodiments, where the first outer surface 308 and the first flange first surface 316 meet is rounded (e.g., not a sharp corner). This rounded interface between the first outer surface 308 and the first flange first surface 316 may assist in biasing a sealing member, positioned between the first flange 314 and the top basin surface 110, toward the surfaces defining the drain opening 130 to create a watertight seal between the top basin surface 110 and the first flange 314.

The first flange first surface 316 is contiguous with the first flange second surface 318. The first flange second surface 318 may be concentric about the center axis Z. The first flange second surface 318 is contiguous with the first flange third surface 320. The first flange third surface 320 may meet the first flange first surface 316 at a corner such that there is no first flange second surface 318. In some embodiments, the first flange second surface 318 is chamfered such that the transition between the first flange first surface 316 and the first flange third surface 320 is smooth (e.g., rounded, uninterrupted, etc.). The first flange third surface 320 is also contiguous with the first inner surface 310. The first flange third surface 320 may be perpendicular to and concentric about the first inner surface 310. In some embodiments, where the first flange third surface 320 and the first inner surface 310 meet may be chamfered such that the transition from the first flange third surface 320 to the first inner surface 310 is uninterrupted by a sharp corner or similar discontinuity (e.g., smooth, rounded, continuous, etc.).

The drain body 220 further includes a generally annular, threaded body, shown as first body threads 330. The first body threads 330 interrupt the first outer surface 308 such that a portion of the first outer surface 308 exists between the first upper end 304 and the first body threads 330. In some embodiments, the first body threads 330 are disposed proximate to the first lower end 306 such that the first outer surface 308 does not exist between the first body threads 330 and the first lower end 306. In some embodiments, the first body threads 330 extend between the first upper end 304 and the first lower end 306 such that the first outer surface 308 is entirely covered by the first body threads 330. As shown in FIG. 4, the first body threads 330 extend between the first lower end 306 and approximately half-way between the first upper end 304 and the first lower end 306. The first body threads 330 may be manufactured from brass, steel, aluminum, plastic, titanium, rubber, or similar materials. The first body threads 330 may be manufactured into the first outer surface 308 such that the drain body 220 and the first body threads 330 are a single body (e.g., all one piece, etc.). In some embodiments, the first body threads 330 are manufactured separately from the drain body 220 and later coupled to the first outer surface 308 by fasteners, interference fit, friction, adhesives, glue, or by similar coupling means. The first body threads 330 may be concentric about the center axis Z.

The drain body 220 may further include overflow openings 340. The overflow openings interrupt both the first outer surface 308 and the first inner surface 310. The overflow openings 340 may extend through the first outer surface 308 and the first inner surface 310 such that a flow of water may exit the drain body 220 through the overflow openings 340. Each of the overflow openings 340 is defined by a generally rectangular surface, shown as an overflow opening surface 342, contiguous with both the first outer surface 308 and the first inner surface 310.

The drain body 220 further includes a generally annular flange, shown as a second flange 350, disposed within the first inner surface 310 and extending laterally away from the first inner surface 310, toward the center axis Z. As shown in FIG. 4, the second flange 350 may be positioned proximate to the first lower end 306. In some embodiments, the second flange 350 is positioned at a different height such that a portion of the drain body 220 extends between the second flange 350 and the first lower end 306. The second flange 350 may be manufactured from metal, plastic, or similar materials. The second flange 350 may be structurally integrated with the drain body 220, such as is possible though die-casting, injection molding, 3D printing, or similar manufacturing processes. In some embodiments, the second flange 350 is manufactured separately from the drain body 220 and later coupled to the drain body 220 by welding, fasteners, friction, interference fit, or other coupling means.

The second flange 350 includes a generally planar top second flange surface 352 and a generally planar inner second flange surface 354. The top second flange surface 352 is contiguous with the first inner surface 310, and the inner second flange surface 354 is contiguous with the top second flange surface 352. The second flange 350, and more specifically, the inner second flange surface 354, defines a fifth diameter $D_5$, less than the second diameter D2. Generally speaking, second flange 350 is configured to prevent the tailpiece 240 from sliding entirely through the drain body 220. Specifically, the second flange 350 prevents axial movement of the tailpiece 240 in a direction generally away from the first flange 314.

The drain body 220 may further include a groove 360 contiguous with the first inner surface 310. Specifically, the groove 360 may extend from the first inner surface 310 and into the first body 302 in a direction away (e.g., generally away) from the center axis Z. The groove 360 may interrupt the first inner surface 310 such that a portion of the first inner surface 310 extends both above and below the groove 360. In some embodiments, and as shown in FIG. 4, the first outer surface 308 positioned radially from the groove 360 may be annular and void of threads (e.g., does not include the first body threads 330). In some embodiments, the first outer surface 308 positioned radially from the groove 360 may include the first body threads 330. While the groove 360 is shown as being positioned about half-way between the first upper end 304 and the first lower end 306, the groove 360 may, in some embodiments, be positioned at a variety of positions between the first upper end 304 and the first lower end 306. For example, the groove 360 may be positioned nearer to the first lower end 306 than to the first upper end 304.

The groove 360 is configured to receive the retaining ring 235, preventing the retaining ring 235 from moving axially away from the drain body 220 in a direction generally along the center axis Z. The groove 360 defines a first groove surface 362, a second groove surface 364, and a third groove surface 366. The first groove surface 362 may be contiguous with the first inner surface 310 and may be parallel to the top second flange surface 352. The second groove surface 364 may be contiguous with the first groove surface 362 and may be concentric about the center axis Z. The second groove surface 364 may define a groove diameter, the groove diameter greater than the second diameter $D_2$ and less than the third diameter $D_3$. The third groove surface 366 may be contiguous with both the second groove surface 364 and the first inner surface 310 and the third groove surface 366 may be parallel to the first groove surface 362. In some embodiments, the groove 360 may be integrally formed within the drain body 220.

Figure 5:
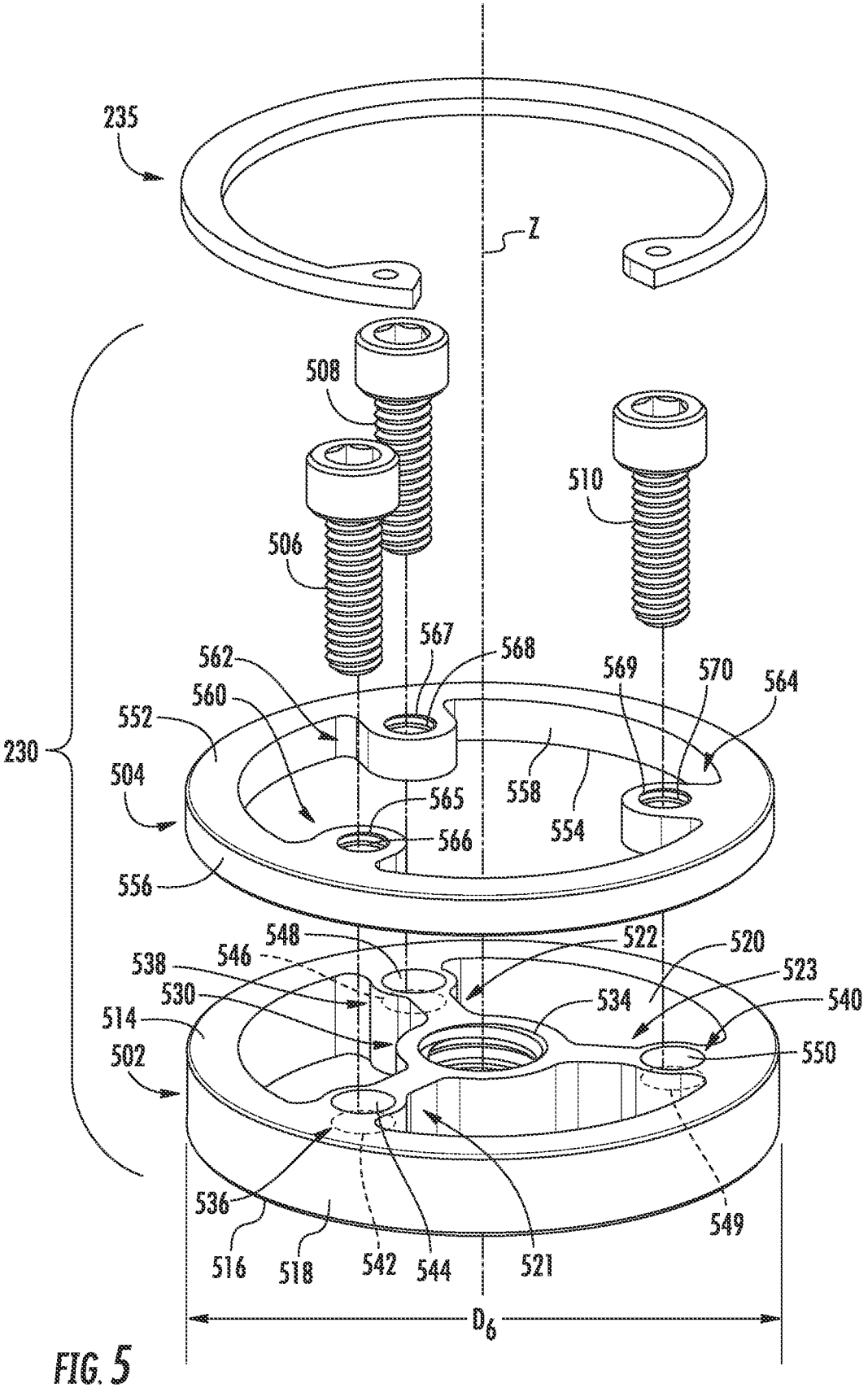
FIG. 5 shows an exploded top view of a portion of the easy drain installation assembly of FIG. 2.

Turning now to FIG. 5, an exploded view of the expanding assembly 230 is shown. The expanding assembly 230 includes a lattice body 502, a washer 504, a first fastener 506, a second fastener 508, and a third fastener 510. The first fastener 506, the second fastener 508, and the third fastener 510 are collectively referred to herein as "the lattice fasteners 505". Generally speaking, the lattice fasteners 505 thread into the washer 504 and rest in (e.g., on) the lattice body 502. As the lattice fasteners 505 are tightened (e.g., further threaded into the washer 504), the washer 504 and the lattice body 502 move away from one another. When the expanding assembly 230 is positioned within the drain body 220, the lattice body 502 and the washer 504 are positioned between the second flange 350 and the groove 360. The retaining ring 235 may then be inserted within the groove 360. After the retaining ring 235 is installed, the lattice fasteners 505 may be tightened, the lattice fasteners 505 applying a force on the lattice body 502 in a direction away from the washer 504, and the lattice fasteners 505 applying a force onto the washer 504 in a direction generally away from the lattice body 502. Eventually, as the lattice fasteners 505 continue to be tightened, the lattice body 502 will be pressed into the second flange 350 and the washer 504 will be pressed into the retaining ring 235. This force compresses a flange of the tailpiece 240 between the lattice body 502 and the second flange 350, retaining the tailpiece 240 within the drain body 220 and preventing translational and axial movement of the tailpiece 240 along the center axis Z. In some embodiments, a sealing member, such as a gasket or O-ring, may be positioned between the flange of the tailpiece 240 and the second flange 350 such that the force applied by the lattice fasteners 505 pinches the sealing member and forms a watertight seal between the tailpiece 240 and the drain body 220.

Referring specifically to the lattice body 502, the lattice body 502 includes a first lattice surface 514, a second lattice surface 516, an outer lattice surface 518, and an inner lattice surface 520. Both the inner lattice surface 520 and the outer lattice surface 518 are contiguous with the first lattice surface 514 and the second lattice surface 516. The outer lattice surface 518 may define a sixth diameter $D_6$, the sixth diameter $D_6$ less than the second diameter $D_2$ and greater than the fifth diameter $D_5$. Extending through both the first lattice surface 514 and the second lattice surface 516 may be a plurality of openings configured to allow a flow of water to pass through the drain body 220, and likewise the tailpiece 240. The lattice body 502 further defines a first support structure 521, a second support structure 522, and a third support structure 523, collectively referred to herein as "the support structures 524," the support structure 524 extending laterally inward from the inner lattice surface 520 and toward the center axis Z. The support structures 524 are configured to allow a flow of water to pass through the drain body 220, such as a flow of water from the wash basin 100.

The support structures 524 may cooperate proximate to the center axis Z to support a generally annular coupling body 530. The coupling body 530 is concentric about the center axis Z. The coupling body 530 includes a coupling body orifice 534 concentric about the center axis Z and configured to accept a fastener, such as may be included in a drain stopper or the toe tap 210. In some embodiments, the coupling body orifice 534 interfaces with the toe tap 210 such that the toe tap 210 may be removably coupled to the lattice body 502. In some embodiments, the coupling body orifice 534 is not required during the installation of the toe tap 210, but gives an installer of the easy drain installation assembly 200 options as to which type of stopper or toe tap 210 they may prefer to use.

The lattice body 502 may further include a first cavity 536 configured to receive the first fastener 506, a second cavity 538 configured to receive the second fastener 508, and a third cavity 540 configured to receive the third fastener 510. The first cavity 536 may be integrated with or formed within the support structures 524. While the first cavity 536, the second cavity 538, and the third cavity 540 are shown in FIG. 5 are positioned proximate to the support structures 524, it is not required that the first cavity 536, the second cavity 538, and the third cavity 540 are positioned rotationally symmetrical about the lattice body 502 or formed within the support structures 524.

The first cavity 536 defines a cavity bottom surface 542 and a cavity inner surface 544. The cavity bottom surface 542 may be positioned between the first lattice surface 514 and the second lattice surface 516. In some embodiments, the cavity bottom surface is nearer to the first lattice surface 514 than to the second lattice surface 516. In some embodiments, the first cavity 536 has zero depth, such that the first lattice surface 514 comprises the cavity bottom surface 542. The cavity inner surface 544 be generally annular. The cavity inner surface 544 may define a cavity diameter larger than a pitch diameter of the threads on the first fastener 506. The first fastener 506 may be configured to thread through the washer 504, extend into the first cavity 536, and interface with the cavity bottom surface 542. In some embodiments, the first fastener 506 interfaces with the cavity inner surface 544. In some embodiments, it may be desirable that the first cavity 536 is not configured to cooperate to couple the first fastener 506 to the lattice body 502. The first cavity 536 is configured to allow the first fastener 506 to rotate freely within the first cavity 536 against the cavity bottom surface 542.

The second cavity 538 defines a cavity bottom surface 546 and a cavity inner surface 548. The cavity bottom surface 546 may be positioned between the first lattice surface 514 and the second lattice surface 516. In some embodiments, the cavity bottom surface 546 is nearer to the first lattice surface 514 than to the second lattice surface 516. In some embodiments, the second cavity 538 has zero depth, such that the first lattice surface 514 comprises the cavity bottom surface 542. The cavity inner surface 548 be generally annular. The cavity inner surface 548 may define a second cavity diameter larger than a second pitch diameter of the threads on the second fastener 508. The second fastener 508 may be configured to thread through the washer 504, extend into the second cavity 538, and interface with the cavity bottom surface 546. In some embodiments, the second fastener 508 interfaces with the cavity inner surface 548. In some embodiments, it may be desirable that the second cavity 538 is not configured to cooperate to couple the second fastener 508 to the lattice body 502. The second cavity 538 is configured to allow the second fastener 508 to rotate freely within the second cavity 538 against the cavity bottom surface 546.

The third cavity 540 defines a cavity bottom surface 549 and a cavity inner surface 550. The cavity bottom surface 549 may be positioned between the first lattice surface 514 and the second lattice surface 516. In some embodiments, the cavity bottom surface 549 is nearer to the first lattice surface 514 than to the second lattice surface 516. In some embodiments, the third cavity 540 has zero depth, such that the first lattice surface 514 comprises the cavity bottom surface 549. The cavity inner surface 550 be generally annular. The cavity inner surface 550 may define a third cavity diameter larger than a third pitch diameter of the threads on the third fastener 510. The third fastener 510 may be configured to thread through the washer 504, extend into the third cavity 540, and interface with the cavity bottom surface 549. In some embodiments, the third fastener 510 interfaces with the cavity inner surface 550. In some embodiments, it may be desirable that the third cavity 540 is not configured to cooperate to couple the third fastener 510 to the lattice body 502. The third cavity 540 is configured to allow the third fastener 510 to rotate freely within the third cavity 540 against the cavity bottom surface 549.

Referring specifically to the washer 504, the washer 504 includes a first washer surface 552, a second washer surface 554, an outer washer surface 556, and an inner washer surface 558. The outer washer surface 556 may define the sixth diameter $D_6$. Each of the first washer surface 552 and the second washer surface 554 are contiguous with both the outer washer surface 556 and the inner washer surface 558. In some embodiments, the inner washer surface 558 and the outer washer surface 556 are concentric about the center axis Z.

The washer 504 further defines a plurality of support structures extending laterally inward from the inner washer surface 558, the plurality of support structures shown as a first washer projection 560, a second washer projection 562, and a third washer projection 564. The plurality of projections extend toward the center axis Z, however, the plurality of projections do not extend over the coupling body 530 when the washer 504 is positioned concentrically about the lattice body 502 (e.g., when the outer washer surface 556 is concentric with the outer lattice surface 518).

The first washer projection 560 includes a first aperture 565 configured to receive the first fastener 506, the first aperture 565 defining a first inner surface 566, the first inner surface 566 extending through the first washer projection 560 and contiguous with both the first washer surface 552 and the second washer surface 554. The first inner surface 566 may be threaded and configured to thread to the first fastener 506. The first fastener 506 may extend through the first aperture 565, threading to the first inner surface 566, and interface with the first cavity 536. A center of the first aperture 565 is positioned a first distance radially outward from the center axis Z, where the first cavity 536 also defines a center positioned the first distance from the center axis Z such that the first aperture 565 may be aligned with the first cavity 536.

The second washer projection 562 includes a second aperture 567 configured to receive the second fastener 508, the second aperture 567 defining a second inner surface 568, the second inner surface 568 extending through the second washer projection 562 and contiguous with both the first washer surface 552 and the second washer surface 554. The second inner surface 568 may be threaded and configured to thread to the second fastener 508. The second fastener 508 may extend through the second aperture 567, threading to the second inner surface 568, and interface with the second cavity 538. A center of the second aperture 567 is positioned a second distance radially outward from the center axis, where the second cavity 538 also defines a center positioned the second distance from the center axis Z such that the second aperture 567 may be aligned with the second cavity 538. The second distance may be equal to the first distance.

The third washer projection 564 includes a third aperture 569 configured to receive the third fastener 510, the third aperture 569 defining a third inner surface 570, the third inner surface 570 extending through the third washer projection 564 and contiguous with both the first washer surface 552 and the second washer surface 554. The third inner surface 570 may be threaded and configured to thread to the third fastener 510. The third fastener 510 may extend through the third aperture 569, threading to the third inner surface 570, and interface with the third cavity 540. A center of the third aperture 569 is positioned a third distance radially outward from the center axis, where the third cavity 540 also defines a center positioned the third distance from the center axis Z such that the third aperture 569 may be aligned with the third cavity 540. The third distance may be equal to the first distance. In some embodiments, the third distance is equal to the second distance. In some embodiments, the third distance is equal to both the first distance and the second distance.

The first aperture 565, the second aperture 567, and the third aperture 569 may be positioned rotationally symmetrically about the washer 504 such that the first aperture 565 and the second aperture are rotationally separated by one-hundred-and-twenty (120) rotational degrees. In some embodiments, the washer 504 does not include the third aperture 569, and the first aperture 565 and the second aperture 567 are separated by one-hundred-and-eighty (180) rotational degrees.

The retaining ring 235 may be an internal retaining ring (e.g., snap ring) or a similar variation of an internal retaining ring (e.g., inverted, bowed, spiral, push-on, etc.) As shown in FIG. 5, the retaining ring 235 is an internal retaining ring configured to be removably coupled to the drain body 220, such as by using an internal snap ring tool. In some embodiments, the retaining ring 235 is a 1.5 inch internal retaining ring. When the retaining ring 235 is coupled to the drain body 220, the retaining ring 235 is configured to extend inwardly toward the center axis Z, the retaining ring 235 extending beyond the first inner surface 310. When the lattice fasteners 505 are coupled to the washer 504 and push the lattice body 502 away from the washer 504, the washer 504 is configured to interface with and push against the retaining ring 235.

Figure 7:
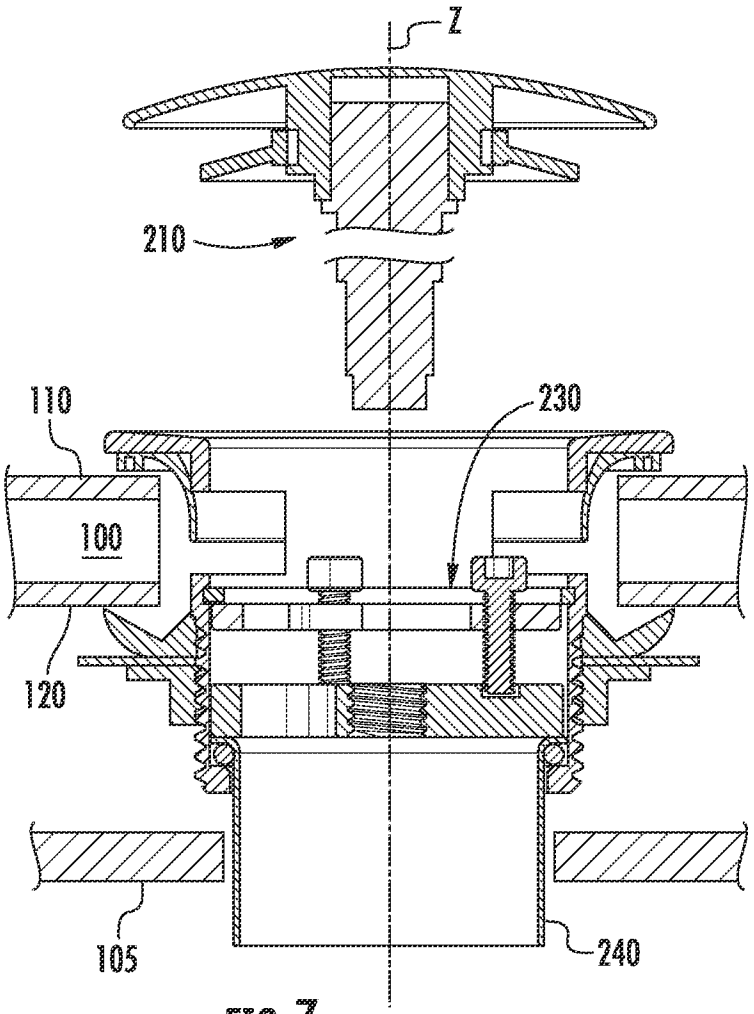
FIG. 7 shows a side, cross-sectional view of the easy drain installation assembly of FIG. 2 fully installed.
Figure 6:
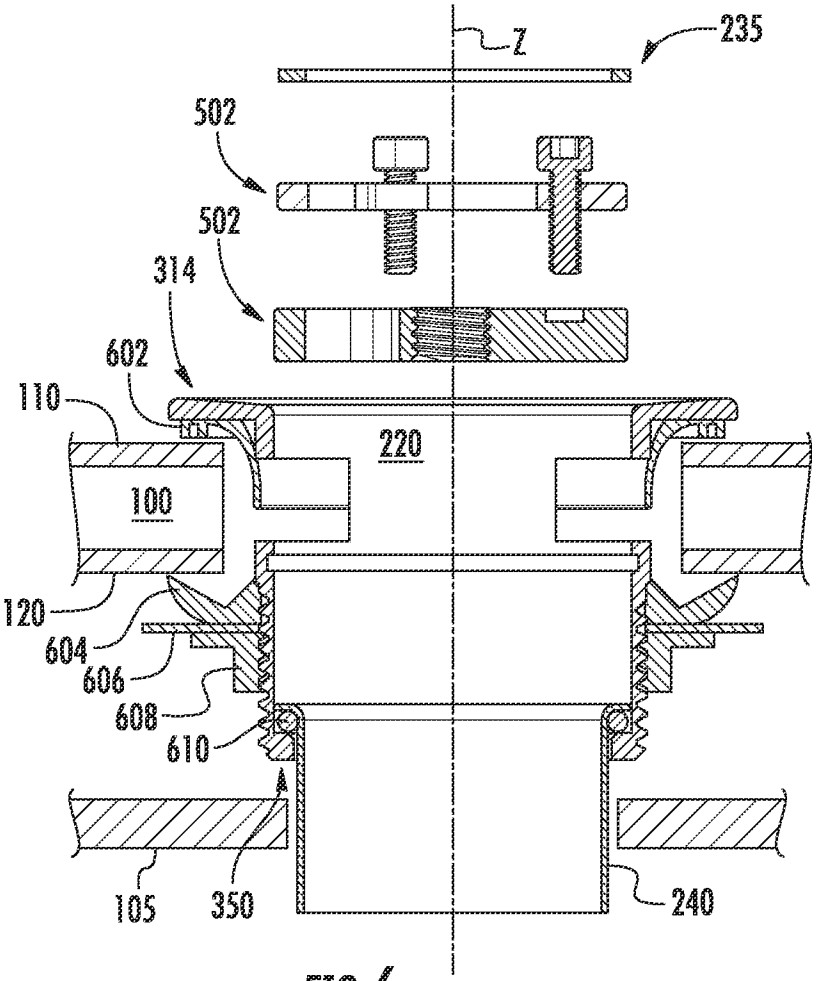
FIG. 6 shows an exploded side, cross-sectional view of the easy drain installation assembly of FIG. 2 partially installed.
Figure 8:
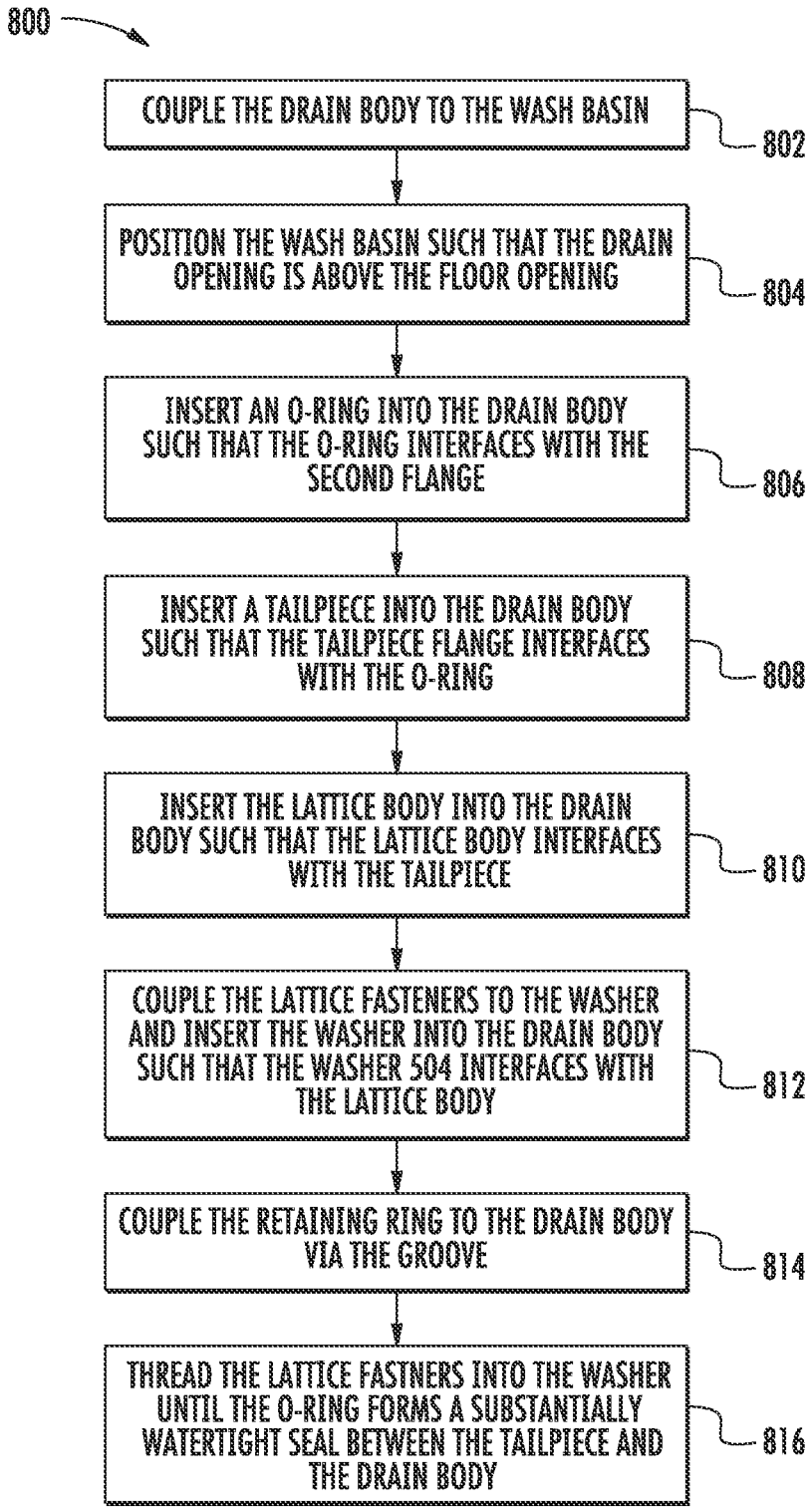
FIG. 8 shows a method of installing the easy drain installation assembly of FIG. 2, according to an exemplary embodiment.

Referring to FIGS. 6, 7, and 8, an exploded, cross-sectional view of a partially installed easy drain installation assembly 200 is shown along with a method 800 for installing the easy drain installation assembly 200. As shown in FIG. 6, the easy drain installation assembly 200 may further include a first sealing member 602, a second sealing member 604, a deck washer 606, and a deck nut 608. When the easy drain installation assembly 200 is installed within a wash basin 100, the first sealing member 602 may be centered on the center axis Z and positioned between the first flange 314 and the top basin surface 110 such that the first sealing member 602 is pinched (e.g., clamped, etc.) between the first flange 314 and the top basin surface 110 such that a watertight seal is formed. In some embodiments, the first sealing member 602 is formed of a compliant material such that the first sealing member 602 deforms when clamped.

When the easy drain installation assembly 200 is installed within a wash basin 100, the second sealing member 604 may be centered on the center axis Z and positioned between the deck nut 608 and the bottom basin surface 120 such that the second sealing member 604 is pinched between the deck nut 608 and the bottom basin surface 120, the second sealing member 604 cooperating with the bottom basin surface 120 to form a watertight seal. In some embodiments, the second sealing member 604 is formed of a compliant material such that the second sealing member 604 deforms when clamped. To facilitate clamping of the second sealing member 604, a deck washer 606 may be interposed between the deck nut 608 and the second sealing member 604, the deck washer 606 serving to distribute the force applied by the deck nut 608 as the deck nut 608 is coupled to the drain body 220. The deck nut 608 is configured to form a threaded connection with the drain body 220 about the first body threads 330.

At 802, the drain body 220 is coupled to (e.g., removably coupled to, threadingly coupled to, etc.) the wash basin 100 within the drain opening 130. Specifically, the drain body 220 is inserted into the drain opening 130 such that the first flange 314 interfaces with the first sealing member 602, and the first sealing member 602 interfaces with the top basin surface 110. The first flange 314 prevents the drain body 220 from sliding through the drain opening 130 and into the floor opening 107. Then, from the underside of the wash basin 100, the second sealing member 604 is disposed on the drain body 220 proximate to the first body threads 330, the second sealing member 604 interfacing with the bottom basin surface 120. The deck washer 606 is slid over the drain body 220 and interfaces with the second sealing member 604. The deck nut 608 is coupled to the drain body 220 (e.g., threadingly coupled to the first body threads 330). The deck nut 608 is tightened until the first sealing member 602 and the second sealing member 604 are compressed, holding the drain body 220 in place relative to the wash basin 100 and forming a watertight seal between the wash basin 100 and the drain body 220.

At 804, the wash basin 100 is positioned such that the drain opening 130 is centered over (e.g., concentric about) the floor opening 107.

At 806, a third seal member, shown as an O-ring 610, is inserted into the drain body 220 from within the wash basin 100 (e.g., from the top basin surface 110). The O-ring 610 is configured to interface with the second flange 350. Specifically, the O-ring 610 may sit on the top second flange surface 352. In some embodiments, the O-ring 610 is slid over the tailpiece 240 until the O-ring 610 interfaces with a tailpiece flange 614.

At 808, the tailpiece 240 is inserted into the drain body 220 from within the wash basin 100. The tailpiece 240 is configured to slide through the drain body 220 until the tailpiece flange 614 interfaces with the O-ring 610. In some embodiments, the tailpiece flange 614 interfaces with the second flange 350. The tailpiece flange 614 defines a tail flange diameter, the tail flange diameter greater than the fourth diameter $D_4$ and less than the fifth diameter $D_5$. The second flange 350 is configured to prevent the tailpiece 240 from sliding all the way through the drain body 220 and falling out of the drain body 220 in a direction generally along the center axis Z.

At 810, the lattice body 502 is inserted into the drain body 220 such that the second lattice surface 516 interfaces with the tailpiece flange 614.

At 812, the lattice fasteners 505 are coupled to the washer 504. Specifically, the first fastener 506 is threaded into the first aperture 565, the second fastener 508 is threaded into the second aperture 567, and the third fastener 510 is threaded into the third aperture 569. The washer 504 coupled to the lattice fasteners 505 is then inserted into the drain body 220, the washer 504 abutting the lattice body 502, the lattice body 502 interposed between the tailpiece 240 and the washer 504. It may be desirable, in some embodiments, to thread the lattice fasteners 505 to the washer 504 prior to inserting the washer 504 into the drain body 220. If the washer 504 is inserted into the drain body 220, and then the installer attempts to thread the lattice fasteners 505 to the washer 504, the installer may run the risk of dropping the lattice fasteners 505 into the drain plumbing below the floor 105. In some embodiments, where the lattice fasteners 505 are threaded into the washer 504 prior to the washer 504 being inserted into the drain body 220, the washer 504 may not interface with the lattice body 502.

At 814, the retaining ring 235 is coupled to the drain body 220. More specifically, the retaining ring 235 is received within the groove 360. The washer 504 is positioned between the retaining ring 235 and the lattice body 502. The retaining ring 235 is configured to prevent the washer 504 from being removed from the drain body 220 while the retaining ring 235 is coupled within the groove 360.

At 816, the lattice fasteners 505 are threaded into the washer 504 until the first washer surface 552 interfaces with the retaining ring 235 and the O-ring 610 is compressed between the tailpiece 240 and the drain body 220, forming a watertight seal. In some embodiments, the washer 504 may be inserted upside-down, such that the second washer surface 554 interfaces with the retaining ring 235. In some embodiments, such as shown in FIG. 7, it may be desirable to thread each of lattice fasteners an equal amount such that the first washer surface 552 is parallel with the third groove surface 366.

Generally speaking, the lattice fasteners 505 are configured to move the washer 504 away from the lattice body 502 such that a force is applied by the washer 504 on the retaining ring 235. The force applied to the retaining ring 235 is also applied to the O-ring 610. The expansion of the expanding assembly 230 compresses the first washer surface 552 against the retaining ring 235 and compresses the O-ring 610 into the top second flange surface 352, the O-ring compressed between the second flange 350 and the tailpiece flange 614. In some embodiments, the desired amount of compression on the O-ring 610 is achieved when each of the first fastener 506, the second fastener 508, and the third fastener 510 are torqued to a predetermined torque. In some embodiments, each of the lattice fasteners 505 includes a fastener head defining a diameter greater than the size of the first, second, and third apertures 565, 567,569. The lattice fasteners 505 may be sized such that when the fastener heads of the lattice fasteners 505 interface with the first washer surface 552, the O-ring 610 is under the desired amount of compression and a watertight seal is formed between the tailpiece 240 and the drain body 220.

Turning now to FIGS. 9-15, an easy drain installation assembly 900 is shown, according to an example embodiment. The easy drain installation assembly 900 is similar to the easy drain installation assembly 200. A difference between the easy drain installation assembly 200 and the easy drain installation assembly 900 is that the easy drain installation assembly 900 includes an externally threaded nut. The easy drain installation assembly 900 includes a drain body 960 and a body nut 965. The body nut 965 is configured to be removably coupled to and received within the drain body 960.

Further configured to be received by the drain body 960 may be a generally cylindrical conduit, shown as a tailpiece 970. The tailpiece 970 may be similar, or identical to, the tailpiece 240, as outlined above with respect to the easy drain installation assembly 200.

Figure 10:
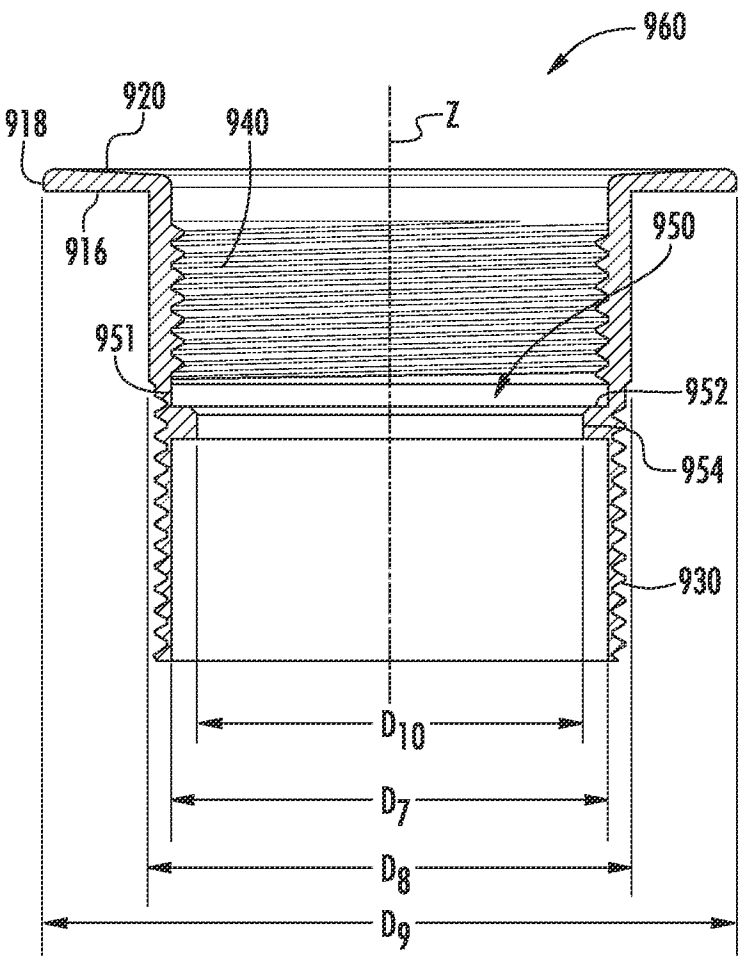
FIG. 10 shows a side, cross-section view of the portion of the easy drain installation assembly of FIG. 9.
Figure 9:
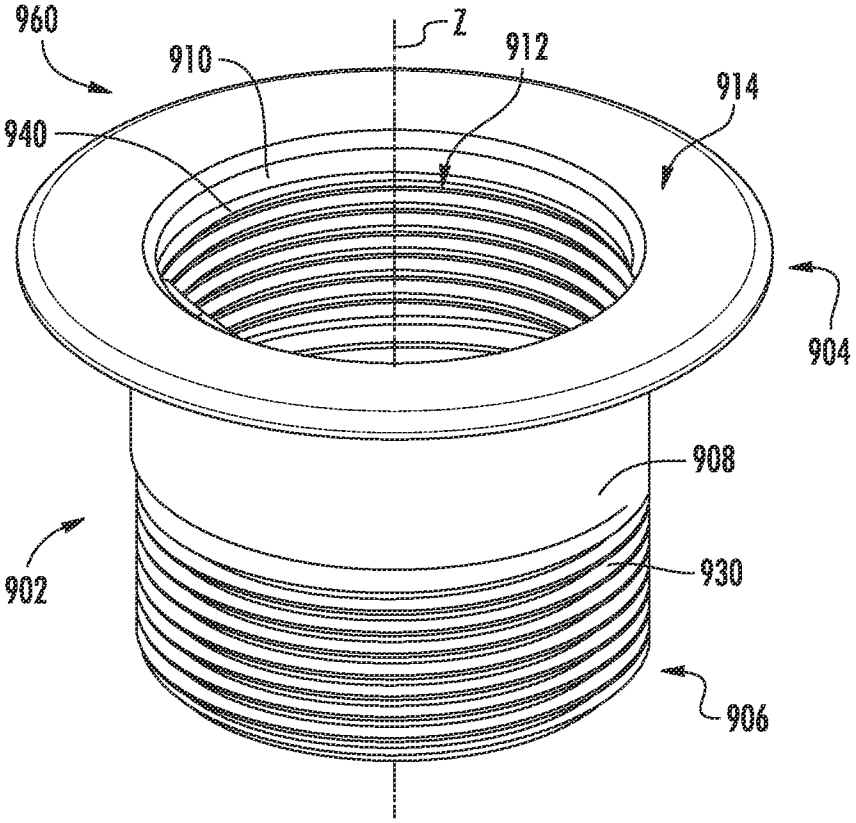
FIG. 9 shows a perspective view of a portion of an easy drain installation assembly according to another example embodiment.

Turning to FIGS. 9 and 10, an exemplary embodiment of the drain body 960 is shown. The drain body 960 includes a generally annular first body 902 having a first upper end 904, a first lower end 906, a first outer surface 908, and a first inner surface 910. The first outer surface 908 and the first inner surface 910 may be concentric about the center axis Z. The first inner surface 910 defines a drain body opening 912 having a seventh diameter $D_7$ proximate to the first lower end 906. In some embodiments, the drain body opening 912 maintains a circular cross-section of the seventh diameter $D_7$ extending between the first upper end 904 and the first lower end 906. In some embodiments, the first outer surface 908 maintains a circular cross-section of an eighth diameter $D_8$ extending between the first upper end 904 and the first lower end 906.

The drain body 960 further includes a generally annular flange, shown as a first flange 914 extending laterally outwardly from (e.g., orthogonal to) the first outer surface 908. As shown in FIG. 4, the first flange 914 extends outwardly proximate to the first upper end 904. In some embodiments, the first flange 914 may extend from the first outer surface 908 at other heights such that a portion of the first body 902 extends above the first flange 914 (e.g., between the first flange 914 and the first upper end 904.) The first flange 914 defines a twelfth diameter $D_{12}$. The twelfth diameter $D_{12}$ may be generally equal to the fourth diameter $D_4$.

The first flange 914 includes a first flange first surface 916, a first flange second surface 918, and a first flange third surface 920. The first flange first surface 916 is contiguous with and concentric about the first outer surface 908. In some embodiments, the first flange first surface 916 is perpendicular to the first outer surface 908. In other embodiments, the first flange first surface 916 meets the first outer surface 908 at an angle other than perpendicular. In some embodiments, where the first outer surface 908 and the first flange first surface 916 meet is rounded (e.g., not a sharp corner). This rounded interface between the first outer surface 908 and the first flange first surface 916 may assist in biasing a sealing member positioned about the drain body 960 proximate to the first flange 914 toward the surfaces defining the drain opening 130 to create a watertight seal between the top basin surface 110 and the first flange 914.

The first flange first surface 916 is contiguous with the first flange second surface 918. The first flange second surface 918 may be concentric about the center axis Z. The first flange second surface 918 is contiguous with the first flange third surface 920. The first flange third surface 920 may meet the first flange first surface 916 at a corner such that there is no first flange second surface 918. In some embodiments, the first flange second surface 918 is chamfered such that the transition between the first flange first surface 916 and the first flange third surface 920 is smooth (e.g., rounded, uninterrupted, etc.). The first flange third surface 920 is also contiguous with the first inner surface 910. The first flange third surface 920 may be perpendicular to and concentric about the first inner surface 910. In some embodiments, where the first flange third surface 920 and the first inner surface 910 meet may be chamfered such that the transition from the first flange third surface 920 to the first inner surface 910 is uninterrupted by a sharp corner or similar discontinuity (e.g., smooth, rounded, continuous, etc.).

The first flange 914, and specifically the first flange second surface 918, may define a ninth diameter $D_9$, the ninth diameter $D_9$ being greater than the drain opening diameter $D_1$ such that the first flange 914 prevents the drain body 960 from falling through the drain opening 130 during installation.

The drain body 960 further includes a generally annular, threaded body, shown as first body threads 930. The first body threads 930 interrupt the first outer surface 908 such that a portion of the first outer surface 908 exists between the first upper end 904 and the first body threads 930. In some embodiments, the first body threads 930 are disposed proximate to the first lower end 906 such that the first outer surface 908 does not exist between the first body threads 930 and the first lower end 906. In some embodiments, the first body threads 930 extend between the first upper end 904 and the first lower end 906 such that the first outer surface 908 is entirely covered by the first body threads 930. As shown in FIG. 10, the first body threads 930 extend between the first lower end 906 and approximately half-way between the first upper end 904 and the first lower end 906. The first body threads 930 may be manufactured from brass, steel, aluminum, plastic, titanium, rubber, or similar materials. The first body threads 930 may be manufactured into the first outer surface 908 such that the drain body 960 and the first body threads 930 are a single body (e.g., all one piece, etc.). In some embodiments, the first body threads 930 are manufactured separately from the drain body 960 and later coupled to the first outer surface 908 by fasteners, interference fit, friction, adhesives, glue, or by similar coupling means. The first body threads 930 may be concentric about the center axis Z. The first body threads 930 are configured to threadingly couple to a nut, such as a deck nut. When the drain body 960 is coupled to the wash basin 100, a sealing member may be positioned between the deck nut and the wash basin 100 such that when the deck nut is threaded onto the first body threads 930 from the underside of the wash basin 100, the seal member is compressed between the deck nut and the bottom basin surface 120.

As shown in FIGS. 9 and 10, the drain body 960 does not include overflow openings, such as the overflow openings 340 of the drain body 220. For applications in which the easy drain installation assembly 900 is installed into a solid surface shower receptacle or plastic receptor, there may exist no overflow channel, and thus it may be desirable, in some embodiments, to not include overflow openings. However, the drain body 960 may still be coupled to a wash basin 100, similar to as is outlined above with respect to the easy drain installation assembly 200. In some embodiments, the drain body 960 includes the overflow openings 340 similar to the overflow opening 340 of the drain body 220, positioned between the first flange 914 and the second flange 950.

The drain body 960 may further include a generally annular, threaded body, shown as second body threads 940. The second body threads 940 extend away from the first inner surface 910 in a direction generally toward the center axis Z. The second body threads 940 may interrupt the first inner surface 910 such that a portion of the first inner surface 910 exists between the first upper end 904 and the second body threads 940. In some embodiments, the second body threads 940 are disposed proximate to the first upper end 904 such that the first inner surface 910 does not exist between the second body threads 940 and the first upper end 904. As shown in FIG. 10, the second body threads 940 extend between the first upper end 904 and approximately half-way between the first upper end 904 and the first lower end 906. The second body threads 940 may be manufactured from brass, steel, aluminum, plastic, titanium, rubber, or similar materials. The second body threads 940 may be manufactured into the first inner surface 910 such that the drain body 960 and the second body threads 940 are a single body (e.g., all one piece, etc.). In some embodiments, the second body threads 940 are manufactured separately from the drain body 960 and later coupled to the first inner surface 910 by fasteners, interference fit, friction, adhesives, glue, or by similar coupling means. The second body threads 940 may be concentric about the center axis Z. The second body threads 940 are configured to be removably coupled to the body nut 965, and more specifically, threadingly coupled to the body nut 965.

The drain body 220 further includes a generally annular flange, shown as a second flange 950, disposed within the drain body 960 and extending laterally away from the first inner surface 310, toward the center axis Z. As shown in FIG. 10, the second flange 950 may be positioned approximately half-way between the first upper end 904 and the first lower end 906. In some embodiments, the second flange 950 is positioned at a different position relative to the first upper end 904. For example, the second flange 950 may be positioned proximate to the first lower end 906, or the second flange 950 may be positioned nearer the first lower end 906 than it is positioned to the first upper end 904. The second body threads 940 may be positioned between the first upper end 904 and the second flange 950. When the drain body 960 is coupled to the wash basin 100 or inserted into a drain hole in a shower receptacle in shower environment, the body nut 965 is threaded to the second body thread 940 and configured to compress the tailpiece 970 between the second flange 950 and the body nut 965. The second flange 950 functions as a stop for the installer of the body nut 965, the second flange 950 indicating to the installer that the body nut 965 is interfacing with the tailpiece 240, a sealing member, or the second flange 950. In some embodiments, a portion 951 of the first inner surface 910 may exist between the second body threads 940 and the second flange 950, the portion 951 being smooth and void of threads. When a seal member is compressed between the tailpiece 970 and the second flange 950, the portion 951 may cooperate with the second flange 950 to provide a smooth surface for the sealing member to compress against. The second flange 950 may be manufactured from metal, plastic, or similar materials. The second flange 950 may be structurally integrated with the drain body 960, such as is possible though die-casting, injection molding, 3D printing, or similar manufacturing processes. In some embodiments, the second flange 950 is manufactured separately from the drain body 960 and later coupled to the drain body 960 by welding, fasteners, friction, interference fit, or other coupling means.

As shown in FIG. 10, a portion of the first outer surface 908 positioned radially from the second body threads 940 may be void of threads. Similarly, a portion of the first inner surface 910 positioned radially from the first body threads 930 may be void of threads. This may be desirable, in some embodiments, as having threads opposite each other (e.g., positioned radially from each other on two different surfaces) may weaken the first body 902 or require the first body 902 to have a greater thickness to accommodate the threads while maintaining the desired rigidity.

The second flange 950 includes a generally planar top second flange surface 952 and a generally planar inner second flange surface 954. The top second flange surface 952 is contiguous with the first inner surface 910, and the inner second flange surface 954 is contiguous with the top second flange surface 952. The second flange 950, and more specifically, the inner second flange surface 954, defines a tenth diameter $D_{10}$, less than the seventh diameter $D_7$. Generally speaking, second flange 950 is configured to prevent the tailpiece 240 from sliding entirely through the drain body 220. Specifically, the second flange 950 prevents translational movement of the tailpiece 240 in a direction generally away from the first flange 914.

Figure 12:
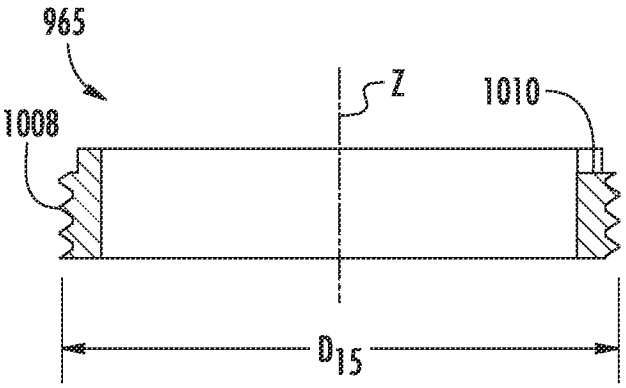
FIG. 12 shows a side, cross-sectional view of the portion of the easy drain installation assembly of FIG. 11.
Figure 11:
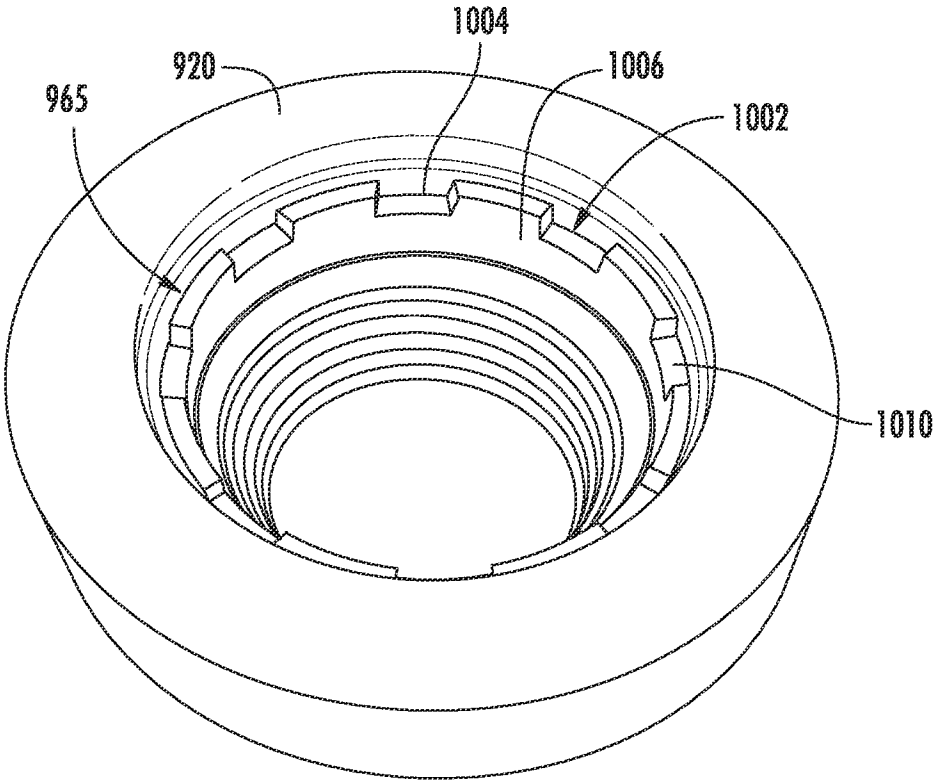
FIG. 11 shows a perspective view of a portion of the easy install drain installation assembly of FIG. 9.

Referring now to FIGS. 11 and 12, an exemplary embodiment of the body nut 965 is shown. The body nut 965 defines a generally annular body, shown as a nut body 1002, the nut body 1002 defining an outer nut surface 1004 and an inner nut surface 1006, the outer nut surface 1004 and the inner nut surface 1006 concentric about the center axis Z. The outer nut surface 1004 defines a diameter, shown as an eleventh diameter $D_{11}$. The eleventh diameter $D_{11}$ is less than the seventh diameter $D_7$ but greater than the tenth diameter $D_{10}$, the eleventh diameter $D_{11}$ structured such that the body nut 965 may be received within the drain body 960 and coupled to the second body threads 940.

Disposed on the outer nut surface 1004 may be a threaded body, shown as nut threads 1008. The nut threads 1008 are structured to be threaded to the second body threads 940.

The body nut 965 may further include a plurality of cut-outs, or notches 1010. The notches may be configured to receive a tool or fixture such that a torque can be applied to the body nut 965 sufficient to compress a sealing member between the tailpiece 970 and the second flange 950.

Figure 14:
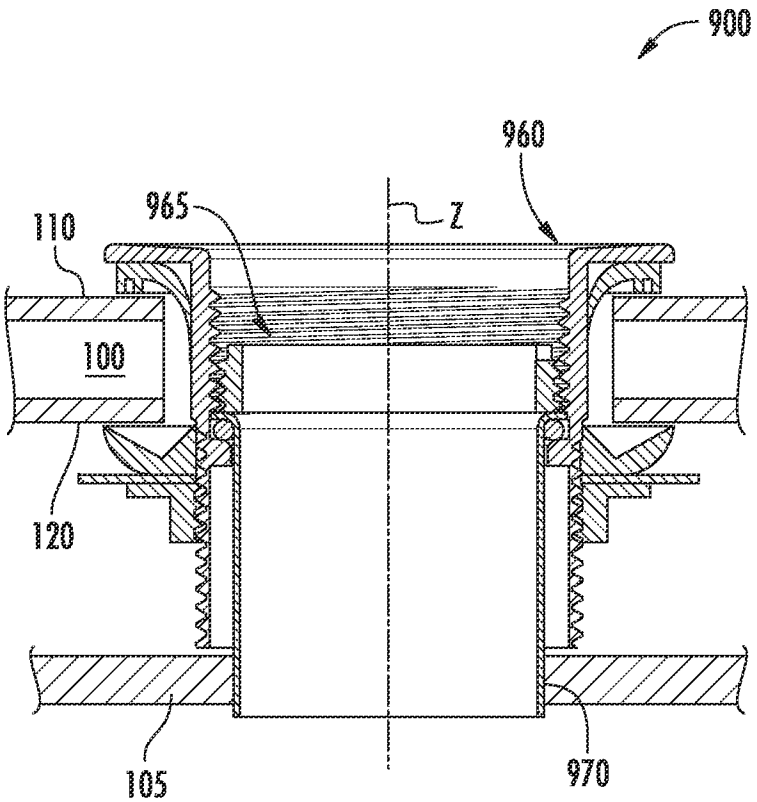
FIG. 14 shows a side, cross-sectional view of the easy drain installation assembly of FIG. 9 fully installed.
Figure 13:
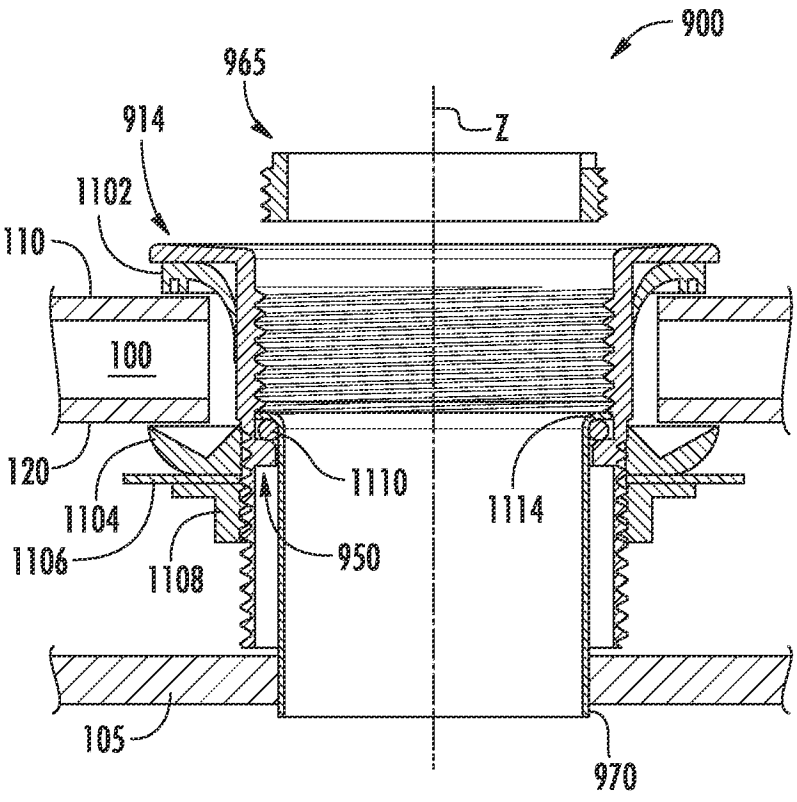
FIG. 13 shows a side, cross-sectional view of the easy drain installation assembly of FIG. 9 partially installed.
Figure 15:
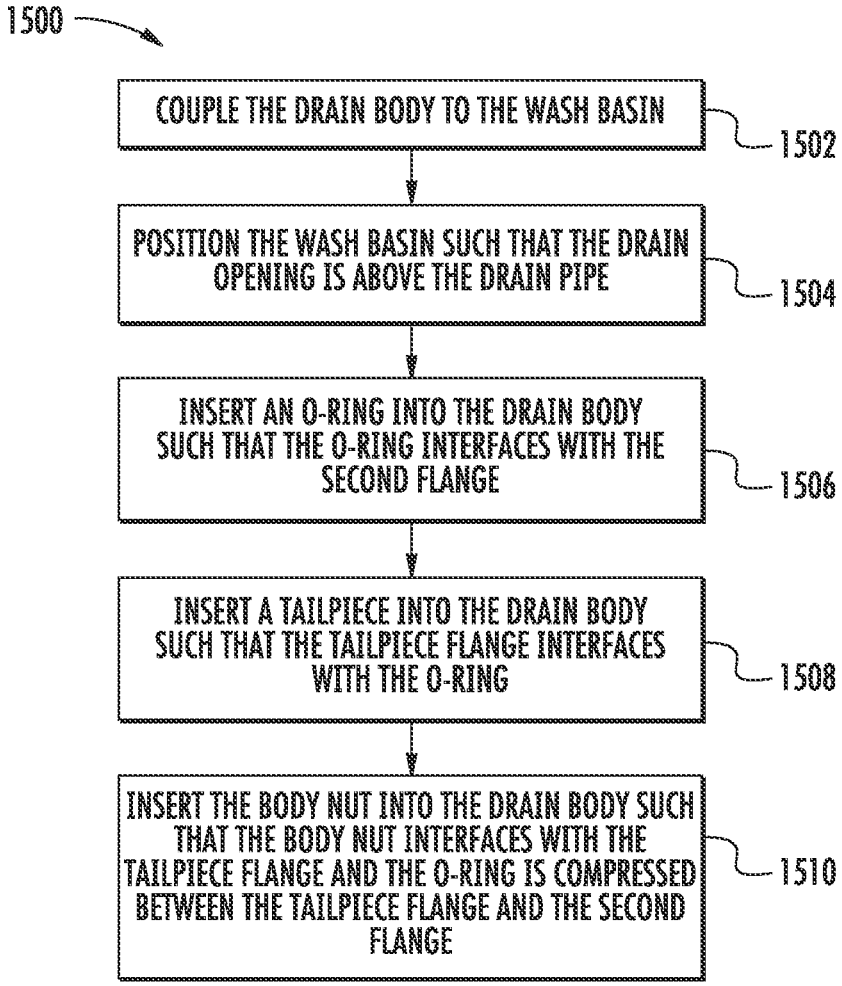
FIG. 15 shows a method of installing the easy drain installation assembly of FIG. 9, according to an exemplary embodiment.

Referring to FIGS. 13, 14, and 15, an exploded, cross-sectional view of a partially installed easy drain installation assembly 900 is shown along with a method 1500 for installing the easy drain installation assembly 900. As shown in FIG. 13, the easy drain installation assembly 900 may further include a first sealing member 1102, a second sealing member 1104, a deck washer 1106, and a deck nut 1108. When the easy drain installation assembly 900 is installed within a wash basin 100, the first sealing member 1102 may be centered on the center axis Z and positioned between the first flange 914 and the top basin surface 110 such that the first sealing member 1102 is pinched (e.g., clamped, etc.) between the first flange 914 and the top basin surface 110 and that a watertight seal is formed. In some embodiments, the first sealing member 1102 is formed of a compliant material such that the first sealing member 1102 deforms when clamped.

When the easy drain installation assembly 900 is installed within (e.g., installed to) a wash basin 100, the second sealing member 1104 may be centered on the center axis Z and positioned between the deck nut 1108 and the bottom basin surface 120 such that the second sealing member 1104 is pinched between the deck nut 1108 and the bottom basin surface 120. In some embodiments, the second sealing member 1104 is formed of a compliant material such that the second sealing member 1104 deforms when clamped. To facilitate clamping of the second sealing member 1104, a deck washer 1106 may be interposed between the deck nut 1108 and the second sealing member 1104, the deck washer 1106 serving to distribute the force applied by the deck nut 1108 as the deck nut 1108 is coupled to the drain body 960. The deck nut 1108 is configured to form a threaded connection with the second body threads 940 of the drain body 960.

At 1502, the drain body 960 is coupled to (e.g., removably coupled to, threadingly coupled to, etc.) the wash basin 100 within the drain opening 130. Specifically, the drain body 960 is inserted into the drain opening 130 such that the first flange 914 interfaces with the first sealing member 1102, and the first sealing member 1102 interfaces with the top basin surface 110. The first flange 914 prevents the drain body 960 from sliding through the drain opening 130 and into the floor opening 107. Then, from the underside of the wash basin 100, the second sealing member 1104 is disposed on the drain body 960 proximate to the first body threads 930, the second sealing member 1104 interfacing with the bottom basin surface 120. The deck washer 1106 is slid over the drain body 960 and interfaces with the second sealing member 1104. The deck nut 1108 is coupled to the drain body 960 (e.g., threadingly coupled to the first body threads 930). The deck nut 1108 is tightened until the first sealing member 1102 and the second sealing member 1104 are compressed, holding the drain body 960 in place relative to the wash basin 100 and forming a watertight seal between the wash basin 100 and the drain body 220.

At 1504, the wash basin 100 is positioned such that the drain opening 130 is centered over (e.g., concentric about) the floor opening 107.

At 1506, a third seal member, shown as an O-ring 1110, is inserted into the drain body 960 from within the wash basin 100 (e.g., from the top basin surface 110). The O-ring 1110 is configured to interface with the second flange 950. Specifically, the O-ring 1110 may sit on the top second flange surface 952. In some embodiments, the O-ring 1110 is slid over the tailpiece 240 until the O-ring 1110 interfaces with the tailpiece flange 1114.

At 1508, the tailpiece 970 is inserted into the drain body 960 from within the wash basin 100. The tailpiece 970 is configured to slide through the drain body 960 until a tailpiece flange 1114 interfaces with the O-ring 1110. In some embodiments, the tailpiece flange 1114 interfaces with the second flange 950. The tailpiece flange 1114 defines a tail flange diameter, the tail flange diameter greater than the tenth diameter $D_{10}$ and less than the seventh diameter $D7_5$. The second flange 950 is configured to prevent the tailpiece 970 from sliding all the way through the drain body 960 and falling out of the drain body 960 in a direction generally along the center axis Z.

At 1510, the body nut 965 is positioned within the drain body 960. Specifically, the body nut 965 is threaded to the second body threads 940 until the body nut 965 interfaces with the tailpiece flange 1114. In some embodiments, threading the body nut 965 may be difficult to do by hand, and a tool or a fixture may be used to help an installer tighten the body nut 965 to the drain body 960. For example, a tool or a fixture may interface with one of the notches 1010, the tool or fixture resting within the notch 1010 and applying a torque to the body nut 965 as an installer applies a torque to the tool or the fixture.

Generally speaking, the body nut 965 is configured to thread to the second body threads 940, the body nut 965 applying an upward force on the drain body 960 and a downward force of the tailpiece flange 1114, the O-ring 1110, and the second flange 950. This compression of the O-ring 1110 compresses the O-ring 1110 against the top second flange surface 952 and the portion 951, the compressed O-ring 1110 forming, in some embodiments, a watertight seal between the drain body 960 and the tailpiece 970.

Turning now to FIGS. 16-21, an easy drain installation assembly 1600 is shown, according to an example embodiment. The easy drain installation assembly 1600 is similar to the easy drain installation assembly 200 of FIGS. 2-8.

Accordingly, like numbering is used to designate like parts between the easy drain installation assembly 1600 and the easy drain installation assembly 200. A difference between the easy drain installation assembly 200 and the easy drain installation assembly 1600 is that the easy drain installation assembly 1600 includes guidance channels within the drain body configured to receive the washer. The easy drain installation assembly 1600 includes a drain body 1620, and an expanding assembly 1630. The expanding assembly 1630 is configured to be received within and coupled to the drain body 1620. In some embodiments, the easy drain installation assembly 1600 includes the drain body 1620, the expanding assembly 1630, and the toe tap 210. The toe tap (e.g., stopper, plug, drain plug, toe touch, foot actuated stopper) 210 may be any variety of drain stopper, including a lift-and-turn stopper, push-and-pull stopper, flip-it stopper, trip lever stopper, pop-up stopper, or similar drain plug or stopper. The toe tap 210 is configured to be disposed within and received by the drain body 1620. When the expanding assembly 1630 is disposed within the drain body 1620, the toe tap 210 may be received within the drain body 1620 and removably coupled to (e.g., threadingly coupled to, etc.) the expanding assembly 1630. A portion of the toe tap 210 extends out of the drain body 1620. The drain body 1620 and the toe tap 210 are configured to cooperate to selectively prevent a flow of water, such as from the wash basin 100, through the drain body 1620.

Figure 17:
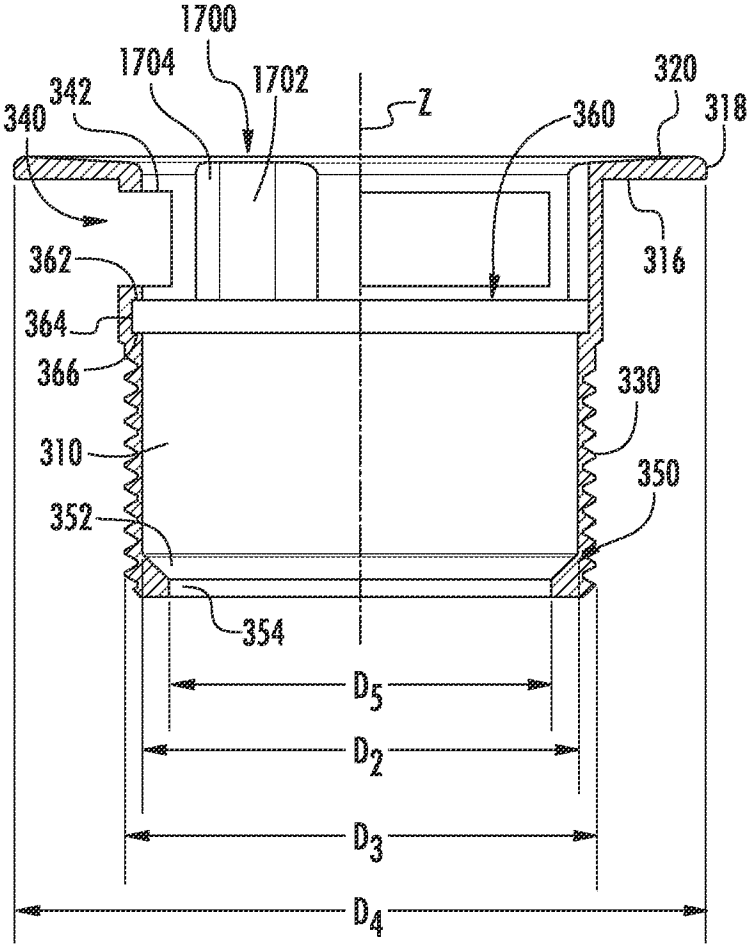
FIG. 17 shows a side, cross-section view of the portion of the easy drain installation assembly of FIG. 16.
Figure 16:
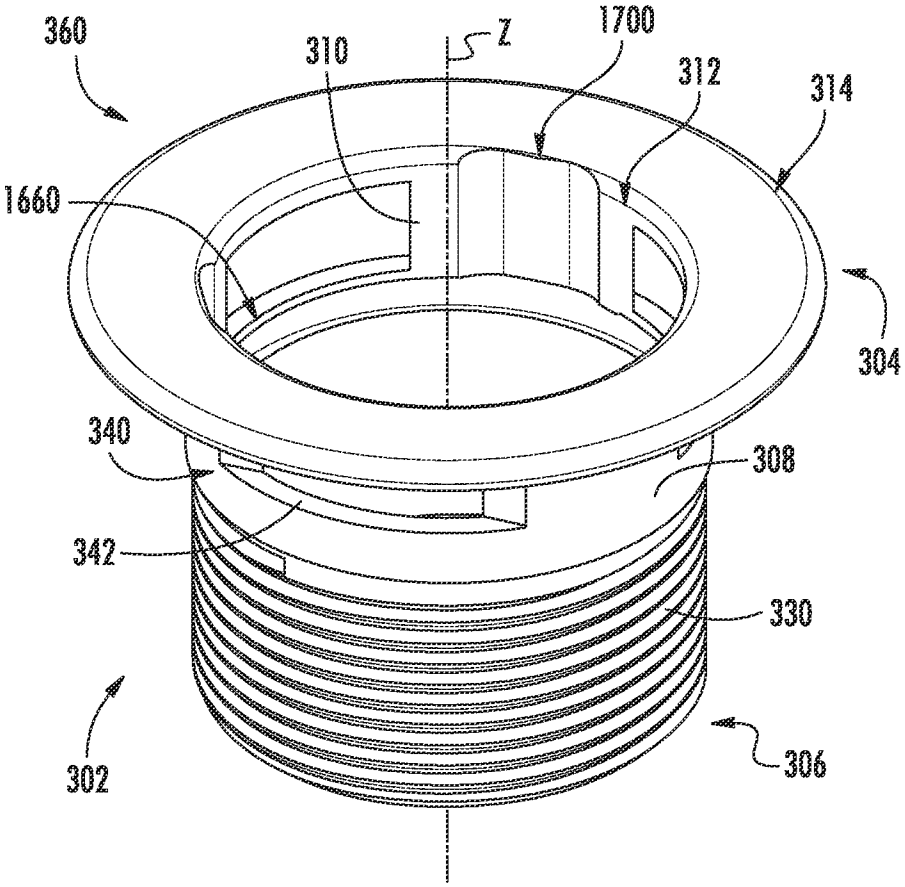
FIG. 16 shows a perspective view of a portion of an easy drain installation assembly according to another example embodiment.

Turning to FIGS. 16 and 17, an exemplary embodiment of the drain body 1620 is shown. The drain body 1620 is similar to the drain body 220 of FIGS. 3 and 4. Accordingly, like numbering is used to designate like parts between the drain body 1620 and the drain body 220.

The drain body 1620 includes a generally annular first body 302 having a first upper end 304, a first lower end 306, a first outer surface 308, and a first inner surface 310. The first outer surface 308 and the first inner surface 310 may be concentric about the center axis Z. The first inner surface 310 defines a drain body opening 312 having a second diameter $D_2$ proximate to the first lower end 306. The drain body opening 312 may maintain a circular cross-section of the second diameter $D_2$ extending between the first upper end 304 and the first lower end 306. The first outer surface 308 may maintain a circular cross-section of the third diameter $D_3$ extending between the first upper end 304 and the first lower end 306. The third diameter $D_3$ may be less than the drain opening diameter $D_1$ such that the drain body 1620 may extend into the drain opening 130.

The drain body 1620 further includes a generally annular flange, shown as a first flange 314 extending laterally outwardly from (e.g., orthogonal to) the first outer surface 308. As shown in FIG. 17, the first flange 314 extends outwardly from the first upper end 304. In some embodiments, the first flange 314 may extend from the first outer surface 308 at other heights such that a portion of the first body 302 extends above the first flange 314 (e.g., between the first flange 314 and the first upper end 304.) The first flange 314 may define the fourth diameter $D_4$. The fourth diameter $D_4$ may be greater than the drain opening diameter $D_1$ such that the first flange 314 may prevent the drain body 1620 from falling completely through the drain opening 130 during installation.

The first flange 314 includes a first flange first surface 316, a first flange second surface 318, and a first flange third surface 320. The first flange first surface 316 is contiguous with and concentric about the first outer surface 308. In some embodiments, the first flange first surface 316 is perpendicular to the first outer surface 308. In other embodiments, the first flange first surface 316 meets the first outer surface 308 at an angle other than perpendicular. In some embodiments, where the first outer surface 308 and the first flange first surface 316 meet is rounded (e.g., not a sharp corner). This rounded interface between the first outer surface 308 and the first flange first surface 316 may assist in biasing a sealing member, positioned between the first flange 314 and the top basin surface 110, toward the surfaces defining the drain opening 130 to create a watertight seal between the top basin surface 110 and the first flange 314.

The first flange first surface 316 is contiguous with the first flange second surface 318. The first flange second surface 318 may be concentric about the center axis Z. The first flange second surface 318 is contiguous with the first flange third surface 320. The first flange third surface 320 may meet the first flange first surface 316 at a corner such that there is no first flange second surface 318. In some embodiments, the first flange second surface 318 is chamfered such that the transition between the first flange first surface 316 and the first flange third surface 320 is smooth (e.g., rounded, uninterrupted, etc.). The first flange third surface 320 is also contiguous with the first inner surface 310. The first flange third surface 320 may be perpendicular to and concentric about the first inner surface 310. In some embodiments, where the first flange third surface 320 and the first inner surface 310 meet may be chamfered such that the transition from the first flange third surface 320 to the first inner surface 310 is uninterrupted by a sharp corner or similar discontinuity (e.g., smooth, rounded, continuous, etc.).

The drain body 1620 further includes a generally annular, threaded body, shown as first body threads 330. The first body threads 330 interrupt the first outer surface 308 such that a portion of the first outer surface 308 exists between the first upper end 304 and the first body threads 330. In some embodiments, the first body threads 330 are disposed proximate to the first lower end 306 such that the first outer surface 308 does not exist between the first body threads 330 and the first lower end 306. In some embodiments, the first body threads 330 extend between the first upper end 304 and the first lower end 306 such that the first outer surface 308 is entirely covered by the first body threads 330. As shown in FIG. 17, the first body threads 330 extend between the first lower end 306 and approximately half-way between the first upper end 304 and the first lower end 306. The first body threads 330 may be manufactured from brass, steel, aluminum, plastic, titanium, rubber, or similar materials. The first body threads 330 may be manufactured into the first outer surface 308 such that the drain body 1620 and the first body threads 330 are a single body (e.g., all one piece, etc.). In some embodiments, the first body threads 330 are manufactured separately from the drain body 1620 and later coupled to the first outer surface 308 by fasteners, interference fit, friction, adhesives, glue, or by similar coupling means. The first body threads 330 may be concentric about the center axis Z.

The drain body 1620 may further include overflow openings 340. The overflow openings interrupt both the first outer surface 308 and the first inner surface 310. The overflow openings 340 may extend through the first outer surface 308 and the first inner surface 310 such that a flow of water may exit the drain body 1620 through the overflow openings 340. Each of the overflow openings 340 is defined by a generally rectangular surface, shown as an overflow opening surface 342, contiguous with both the first outer surface 308 and the first inner surface 310.

The drain body 1620 further includes a generally annular flange, shown as a second flange 350, disposed within the first inner surface 310 and extending laterally away from the first inner surface 310, toward the center axis Z. As shown in FIG. 4, the second flange 350 may be positioned proximate to the first lower end 306. In some embodiments, the second flange 350 is positioned at a different height such that a portion of the drain body 1620 extends between the second flange 350 and the first lower end 306. The second flange 350 may be manufactured from metal, plastic, or similar materials. The second flange 350 may be structurally integrated with the drain body 1620, such as is possible though die-casting, injection molding, 3D printing, or similar manufacturing processes. In some embodiments, the second flange 350 is manufactured separately from the drain body 1620 and later coupled to the drain body 1620 by welding, fasteners, friction, interference fit, or other coupling means.

The second flange 350 includes a generally planar top second flange surface 352 and a generally planar inner second flange surface 354. The top second flange surface 352 is contiguous with the first inner surface 310, and the inner second flange surface 354 is contiguous with the top second flange surface 352. The second flange 350, and more specifically, the inner second flange surface 354, may define the fifth diameter $D_5$, the fifth diameter $D_5$ being less than the second diameter D2. Generally speaking, second flange 350 is configured to prevent the tailpiece 240 from sliding entirely through the drain body 1620. Specifically, the second flange 350 prevents axial movement of the tailpiece 240 in a direction generally away from the first flange 314. In some embodiments, the top second flange surface 352 may extend away from the first inner surface 310 in a direction both toward the center axis Z and away from the first flange 314, providing a ramped surface between the first inner surface 310 and the inner second flange surface 354. The tapering of the top second flange surface 352 may facilitate forming a seal between the tailpiece 240 and the second flange 350. For example, a sealing member, such as the O-ring 610, may be positioned between the tailpiece 240 and the second flange 350, the top second flange surface 352 acting as a wedge to bias the O-ring 610 toward the center axis Z and into the tailpiece 240 when the tailpiece 240 is biased into the second flange 350 by the expanding assembly 230.

The drain body 1620 may further include a groove 360 contiguous with the first inner surface 310. Specifically, the groove 360 may extend from the first inner surface 310 and into the first body 302 in a direction away (e.g., generally away) from the center axis Z. The groove 360 may interrupt the first inner surface 310 such that a portion of the first inner surface 310 extends both above and below the groove 360. In some embodiments, and as shown in FIG. 17, the first outer surface 308 positioned radially from the groove 360 may be annular and void of threads (e.g., does not include the first body threads 330). In some embodiments, the first outer surface 308 positioned radially from the groove 360 may include the first body threads 330. While the groove 360 is shown as being positioned about half-way between the first upper end 304 and the first lower end 306, the groove 360 may, in some embodiments, be positioned at a variety of positions between the first upper end 304 and the first lower end 306. For example, the groove 360 may be positioned nearer to the first lower end 306 than to the first upper end 304.

The groove 360 is configured to receive a portion of the expanding assembly 1630, selectively preventing the portion of the expanding assembly 1630 from moving axially away from the drain body 1620 in a direction generally along the center axis Z. The groove 360 defines a first groove surface 362, a second groove surface 364, and a third groove surface 366. The first groove surface 362 may be contiguous with the first inner surface 310 and may be parallel to the top second flange surface 352. The second groove surface 364 may be contiguous with the first groove surface 362 and may be concentric about the center axis Z. The second groove surface 364 may define a groove diameter, the groove diameter greater than the second diameter $D_2$ and less than the third diameter $D_3$. The third groove surface 366 may be contiguous with both the second groove surface 364 and the first inner surface 310 and the third groove surface 366 may be parallel to the first groove surface 362. In some embodiments, the groove 360 may be integrally formed within the drain body 1620.

The drain body 1620 may further include a guidance channel (e.g., cut-out, etc.) 1700. The guidance channel 1700 may interrupt the first inner surface 310 between the first flange 314 and the groove 360, and may extend between the first flange 314 and the groove 360. In some embodiments, the guidance channel 1700 is alternately positioned between the overflow openings 340 about the portion of the drain body 1620 between the groove 360 and the first flange 314. The guidance channel 1700 may be formed within the drain body 1620 may thinning a portion of the material of the drain body 1620 positioned between the first flange 314 and the groove 360.

The guidance channel 1700 is configured to receive a portion of the expanding assembly 1630. Generally speaking, a portion of the expanding assembly 1630 defines a diameter greater than the second diameter $D_2$. To facilitate the insertion of the expanding assembly 1630 into the drain body 1620, the drain body 1620 may include the guidance channel 1700. As shown in FIGS. 16 and 17, the drain body 1620 may include a three guidance channels 1700. However, in some embodiments, the drain body 1620 may include fewer (e.g., 1) or more (e.g., 4) guidance channels 1700. The guidance channel 1700 defines a first guide surface 1702 and a pair of side guide surfaces 1704. The first guide surface 1702 may be positioned between the first inner surface 310 and the first outer surface 308. In some embodiments, the first guide surface 1702 is contiguous with the second groove surface 364. In some embodiments, such as when the drain body 1620 includes three guidance channels 1700, the first guide surface 1702 of each of the three guidance channels 1700 may cooperate to define a diameter equal to the diameter of the second groove surface 364 (e.g., a diameter between the second diameter $D_2$ and the third diameter $D_3$). The side guide surface 1704 may be contiguous with the first guide surface 1702 and with the first inner surface 310. When the expanding assembly 1630 is positioned within the guidance channels 1700, the side guide surfaces 1704 may be configured to prevent rotation of the expanding assembly 1630 about the center axis Z relative to the drain body 1620.

Figure 18:
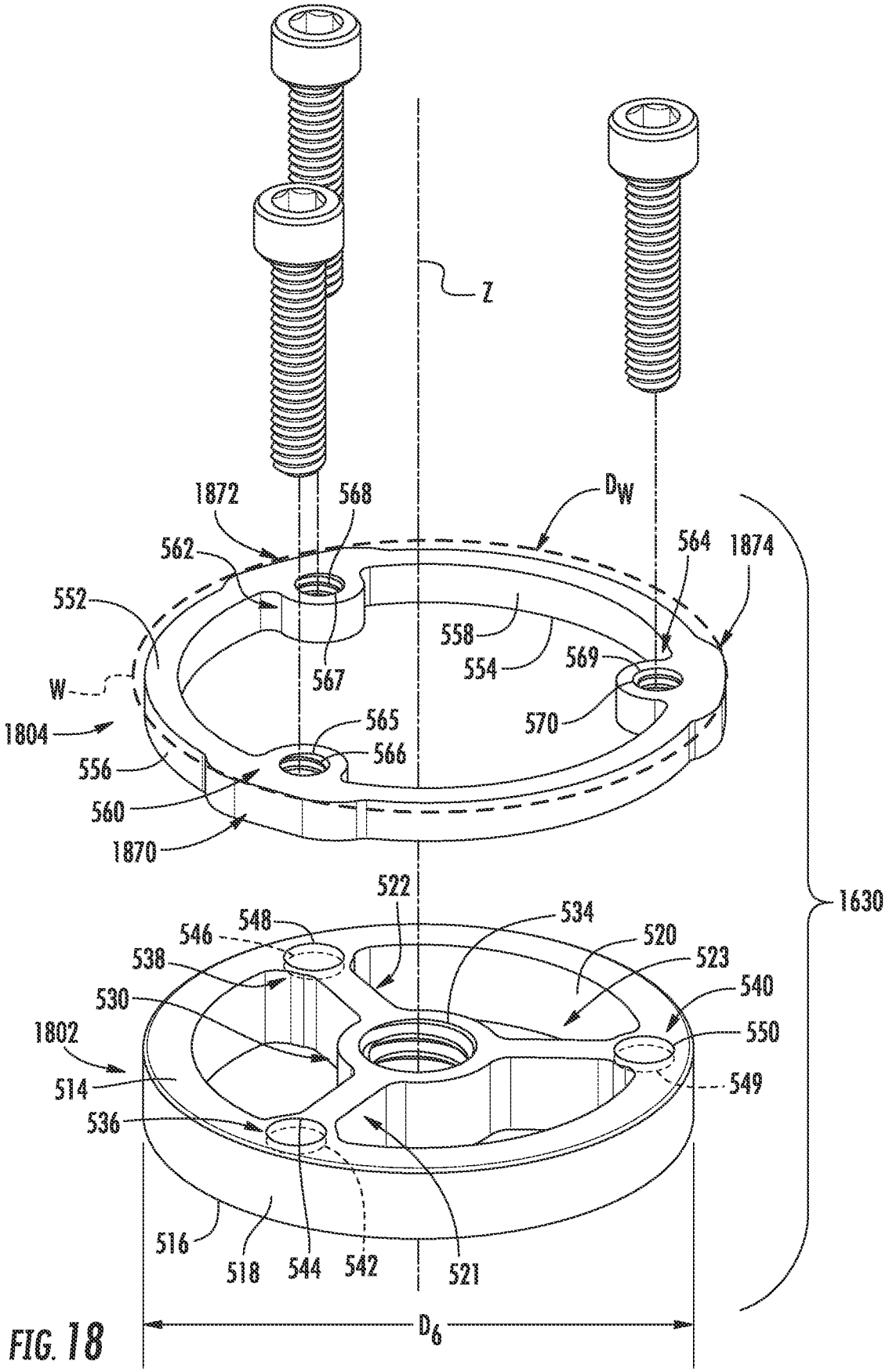
FIG. 18 shows a perspective view of a portion of the easy install drain installation assembly of FIG. 16.

Turning now to FIG. 18, an exploded view of the expanding assembly 1630 is shown. The expanding assembly 1630 includes a lattice body 1802, a washer 1804, a first fastener 506, a second fastener 508, and a third fastener 510. The first fastener 506, the second fastener 508, and the third fastener 510 are collectively referred to herein as "the lattice fasteners 505". Generally speaking, the lattice fasteners 505 thread into the washer 1804 and rest in (e.g., on) the lattice body 1802. As the lattice fasteners 505 are tightened (e.g., further threaded into the washer 1804), the washer 1804 and the lattice body 1802 move away from one another. When the expanding assembly 230 is positioned within the drain body 1620, the washer 1804 may slide in the guidance channel 1700 toward the groove 360, coming to rest on the third groove surface 366. The washer 1804 may then be rotated such that the washer 1804 interfaces with the first groove surface 362 when the lattice fasteners 505 are tightened. Eventually, as the lattice fasteners 505 continue to be tightened, the lattice body 1802 will be biased toward the second flange 350 and the washer 1804 will be pressed into the groove 360. This force compresses a flange of the tailpiece 240 between the lattice body 1802 and the second flange 350, retaining the tailpiece 240 within the drain body 1620 and preventing translational and axial movement of the tailpiece 240 along the center axis Z. In some embodiments, a sealing member, such as a gasket or the O-ring 610, may be positioned between the tailpiece flange 614 and the second flange 350 such that the force applied by the lattice fasteners 505 pinches the O-ring 610 and forms a watertight seal between the tailpiece 240 and the drain body 1620.

Referring specifically to the lattice body 1802, the lattice body 1802 is similar to the lattice body 502. Accordingly, like numbering is used to designate like parts between the lattice body 1802 and the lattice body 502.

The lattice body 1802 includes a first lattice surface 514, a second lattice surface 516, an outer lattice surface 518, and an inner lattice surface 520. Both the inner lattice surface 520 and the outer lattice surface 518 are contiguous with the first lattice surface 514 and the second lattice surface 516. The outer lattice surface 518 may define a sixth diameter $D_6$, the sixth diameter $D_6$ less than the second diameter $D_2$ and greater than the fifth diameter $D_5$. Extending through both the first lattice surface 514 and the second lattice surface 516 may be a plurality of openings configured to allow a flow of water to pass through the drain body 1620, and likewise the tailpiece 240. The lattice body 1802 further defines a first support structure 521, a second support structure 522, and a third support structure 523, collectively referred to herein as "the support structures 524, the support structure 524 extending laterally inward from the inner lattice surface 520 and toward the center axis Z. The support structures 524 are configured to allow a flow of water to pass through the drain body 1620, such as a flow of water from the wash basin 100.

The support structures 524 may cooperate proximate to the center axis Z to support a generally annular coupling body 530. The coupling body 530 is concentric about the center axis Z. The coupling body 530 includes a coupling body orifice 534 concentric about the center axis Z and configured to accept a fastener, such as may be included in a drain stopper or the toe tap 210. In some embodiments, the coupling body orifice 534 interfaces with the toe tap 210 such that the toe tap 210 may be removably coupled to the lattice body 1802. In some embodiments, the coupling body orifice 534 is not required during the installation of the toe tap 210, but gives an installer of the easy drain installation assembly 1600 options as to which type of stopper or toe tap 210 they may prefer to use.

The lattice body 1802 may further include a first cavity 536 configured to receive the first fastener 506, a second cavity 538 configured to receive the second fastener 508, and a third cavity 540 configured to receive the third fastener 510. The first cavity 536 may be integrated with or formed within the support structures 524. While the first cavity 536, the second cavity 538, and the third cavity 540 are shown in FIG. 18 are positioned proximate to the support structures 524, it is not required that the first cavity 536, the second cavity 538, and the third cavity 540 are positioned rotationally symmetrical about the lattice body 1802 or formed within the support structures 524.

The first cavity 536 defines a cavity bottom surface 542 and a cavity inner surface 544. The cavity bottom surface 542 may be positioned between the first lattice surface 514 and the second lattice surface 516. In some embodiments, the cavity bottom surface is nearer to the first lattice surface 514 than to the second lattice surface 516. In some embodiments, the first cavity 536 has zero depth, such that the first lattice surface 514 comprises the cavity bottom surface 542. The cavity inner surface 544 be generally annular. The cavity inner surface 544 may define a cavity diameter larger than a pitch diameter of the threads on the first fastener 506. The first fastener 506 may be configured to thread through the washer 504, extend into the first cavity 536, and interface with the cavity bottom surface 542. In some embodiments, the first fastener 506 interfaces with the cavity inner surface 544. In some embodiments, it may be desirable that the first cavity 536 is not configured to cooperate to couple the first fastener 506 to the lattice body 1802. The first cavity 536 is configured to allow the first fastener 506 to rotate freely within the first cavity 536 against the cavity bottom surface 542.

The second cavity 538 defines a cavity bottom surface 546 and a cavity inner surface 548. The cavity bottom surface 546 may be positioned between the first lattice surface 514 and the second lattice surface 516. In some embodiments, the cavity bottom surface 546 is nearer to the first lattice surface 514 than to the second lattice surface 516. In some embodiments, the second cavity 538 has zero depth, such that the first lattice surface 514 comprises the cavity bottom surface 542. The cavity inner surface 548 be generally annular. The cavity inner surface 548 may define a second cavity diameter larger than a second pitch diameter of the threads on the second fastener 508. The second fastener 508 may be configured to thread through the washer 504, extend into the second cavity 538, and interface with the cavity bottom surface 546. In some embodiments, the second fastener 508 interfaces with the cavity inner surface 548. In some embodiments, it may be desirable that the second cavity 538 is not configured to cooperate to couple the second fastener 508 to the lattice body 1802. The second cavity 538 is configured to allow the second fastener 508 to rotate freely within the second cavity 538 against the cavity bottom surface 546.

The third cavity 540 defines a cavity bottom surface 549 and a cavity inner surface 550. The cavity bottom surface 549 may be positioned between the first lattice surface 514 and the second lattice surface 516. In some embodiments, the cavity bottom surface 549 is nearer to the first lattice surface 514 than to the second lattice surface 516. In some embodiments, the third cavity 540 has zero depth, such that the first lattice surface 514 comprises the cavity bottom surface 549. The cavity inner surface 550 be generally annular. The cavity inner surface 550 may define a third cavity diameter larger than a third pitch diameter of the threads on the third fastener 510. The third fastener 510 may be configured to thread through the washer 504, extend into the third cavity 540, and interface with the cavity bottom surface 549. In some embodiments, the third fastener 510 interfaces with the cavity inner surface 550. In some embodiments, it may be desirable that the third cavity 540 is not configured to cooperate to couple the third fastener 510 to the lattice body 1802. The third cavity 540 is configured to allow the third fastener 510 to rotate freely within the third cavity 540 against the cavity bottom surface 549.

Referring specifically to the washer 1804, the washer 1804 is similar to the washer 504. Accordingly, like numbering is used to designate like parts between the washer 1804 and the washer 1804. A difference between the washer 1804 and the washer 504 is that the washer 1804 includes a plurality of projections extending laterally away from the washer 1804 and away from the center axis Z, the plurality of projections configured to slide though the guidance channels 1700 and interface with the groove 360.

The washer 1804 includes a first washer surface 552, a second washer surface 554, an outer washer surface 556, and an inner washer surface 558. The outer washer surface 556 may define the sixth diameter $D_6$. Each of the first washer surface 552 and the second washer surface 554 are contiguous with both the outer washer surface 556 and the inner washer surface 558. In some embodiments, the inner washer surface 558 and the outer washer surface 556 are concentric about the center axis Z.

The washer 1804 further defines a plurality of support structures extending laterally inward from the inner washer surface 558, the plurality of support structures shown as a first washer projection 560, a second washer projection 562, and a third washer projection 564. The plurality of projections extend toward the center axis Z, however, the plurality of projections do not extend over the coupling body 530 when the washer 1804 is positioned concentrically about the lattice body 1802 (e.g., when the outer washer surface 556 is concentric with the outer lattice surface 518).

The first washer projection 560 includes a first aperture 565 configured to receive the first fastener 506, the first aperture 565 defining a first inner surface 566, the first inner surface 566 extending through the first washer projection 560 and contiguous with both the first washer surface 552 and the second washer surface 554. The first inner surface 566 may be threaded and configured to thread to the first fastener 506. The first fastener 506 may extend through the first aperture 565, threading to the first inner surface 566, and interface with the first cavity 536. A center of the first aperture 565 is positioned a first distance radially outward from the center axis, where the first cavity 536 also defines a center positioned the first distance from the center axis Z such that the first aperture 565 may be aligned with the first cavity 536.

The second washer projection 562 includes a second aperture 567 configured to receive the second fastener 508, the second aperture 567 defining a second inner surface 568, the second inner surface 568 extending through the second washer projection 562 and contiguous with both the first washer surface 552 and the second washer surface 554. The second inner surface 568 may be threaded and configured to thread to the second fastener 508. The second fastener 508 may extend through the second aperture 567, threading to the second inner surface 568, and interface with the second cavity 538. A center of the second aperture 567 is positioned a second distance radially outward from the center axis, where the second cavity 538 also defines a center positioned the second distance from the center axis Z such that the second aperture 567 may be aligned with the second cavity 538. The second distance may be equal to the first distance.

The third washer projection 564 includes a third aperture 569 configured to receive the third fastener 510, the third aperture 569 defining a third inner surface 570, the third inner surface 570 extending through the third washer projection 564 and contiguous with both the first washer surface 552 and the second washer surface 554. The third inner surface 570 may be threaded and configured to thread to the third fastener 510. The third fastener 510 may extend through the third aperture 569, threading to the third inner surface 570, and interface with the third cavity 540. A center of the third aperture 569 is positioned a third distance radially outward from the center axis, where the third cavity 540 also defines a center positioned the third distance from the center axis Z such that the third aperture 569 may be aligned with the third cavity 540. The third distance may be equal to the first distance. In some embodiments, the third distance is equal to the second distance. In some embodiments, the third distance is equal to both the first distance and the second distance.

The first aperture 565, the second aperture 567, and the third aperture 569 may be positioned rotationally symmetrically about the washer 1804 such that the first aperture 565 and the second aperture are rotationally separated by one-hundred-and-twenty (120) rotational degrees. In some embodiments, the washer 1804 does not include the third aperture 569, and the first aperture 565 and the second aperture 567 are separated by one-hundred-and-eighty (180) rotational degrees.

The washer 1804 may further include a plurality of lugs contiguous with and interrupting the outer washer surface 556, extending laterally away from the washer 1804 in a direction away from the center axis Z, shown as a first washer lug 1870, a second washer lug 1872, and a third washer lug 1874, herein referred to "the washer lugs 1875." The washer lugs 1875 are configured to be received within the groove 360 such that the washer 1804 may rotate about the center axis Z relative to the drain body 1620. The washer lugs 1875 define a lug diameter $D_W$, shown by the dotted line W. The lug diameter $D_w$ is greater than the second diameter $D_2$ and less than the third diameter $D_3$. The lug diameter $D_w$ may be slightly smaller than the diameter of the second groove surface 364 such that the washer lugs 1875 interface with the second groove surface 364, forming a slip fit.

The first washer lug 1870 may be positioned radially from the first washer projection 560. Similarly, the second washer lug 1872 may be positioned radially from the second washer projection 562, and the third washer lug 1874 may be positioned radially from the third washer projection 564. While the washer lugs 1875, as shown in the embodiment in FIG. 18, may be positioned equidistant from one another radially about the outer washer surface 556, the washer lugs 1875 may be profiled on the outer washer surface 556 in a variety of positions, such as, for example, the first washer lug 1870 being positioned between the first washer projection 560 and the second washer projection 562, equidistant from both.

Figure 20:
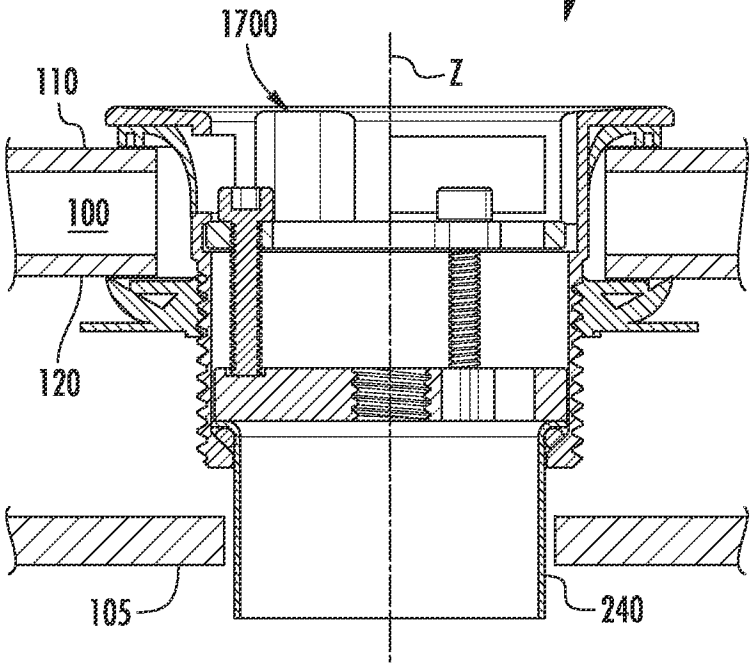
FIG. 20 shows a side, cross-sectional view of the easy drain installation assembly of FIG. 16 fully installed.
Figure 19:
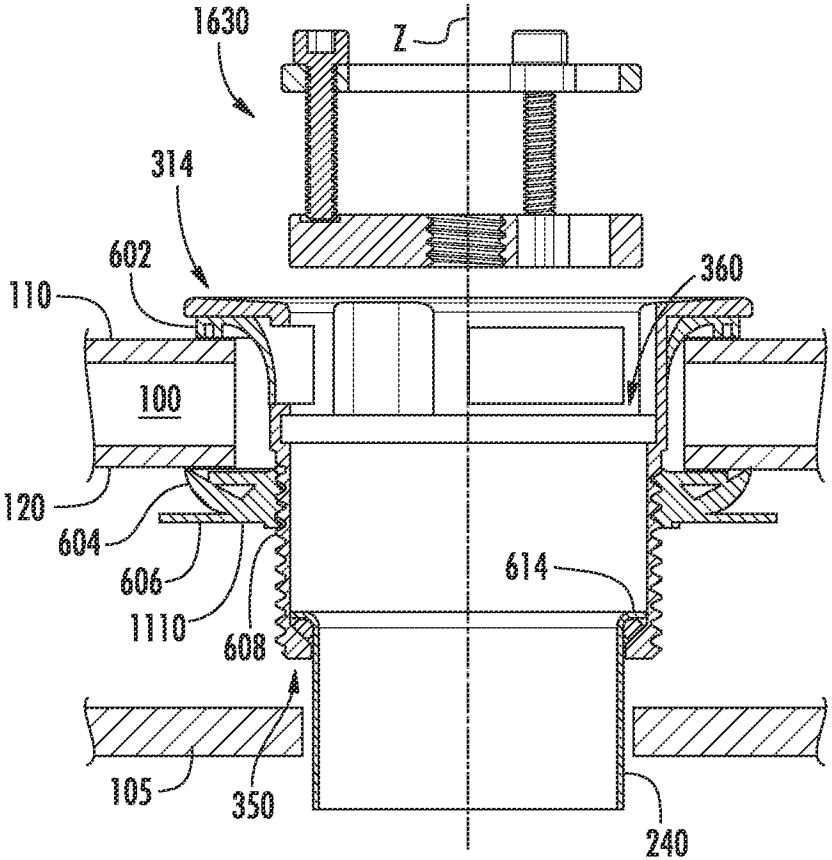
FIG. 19 shows a side, cross-sectional view of the easy drain installation assembly of FIG. 16 partially installed.
Figure 21:
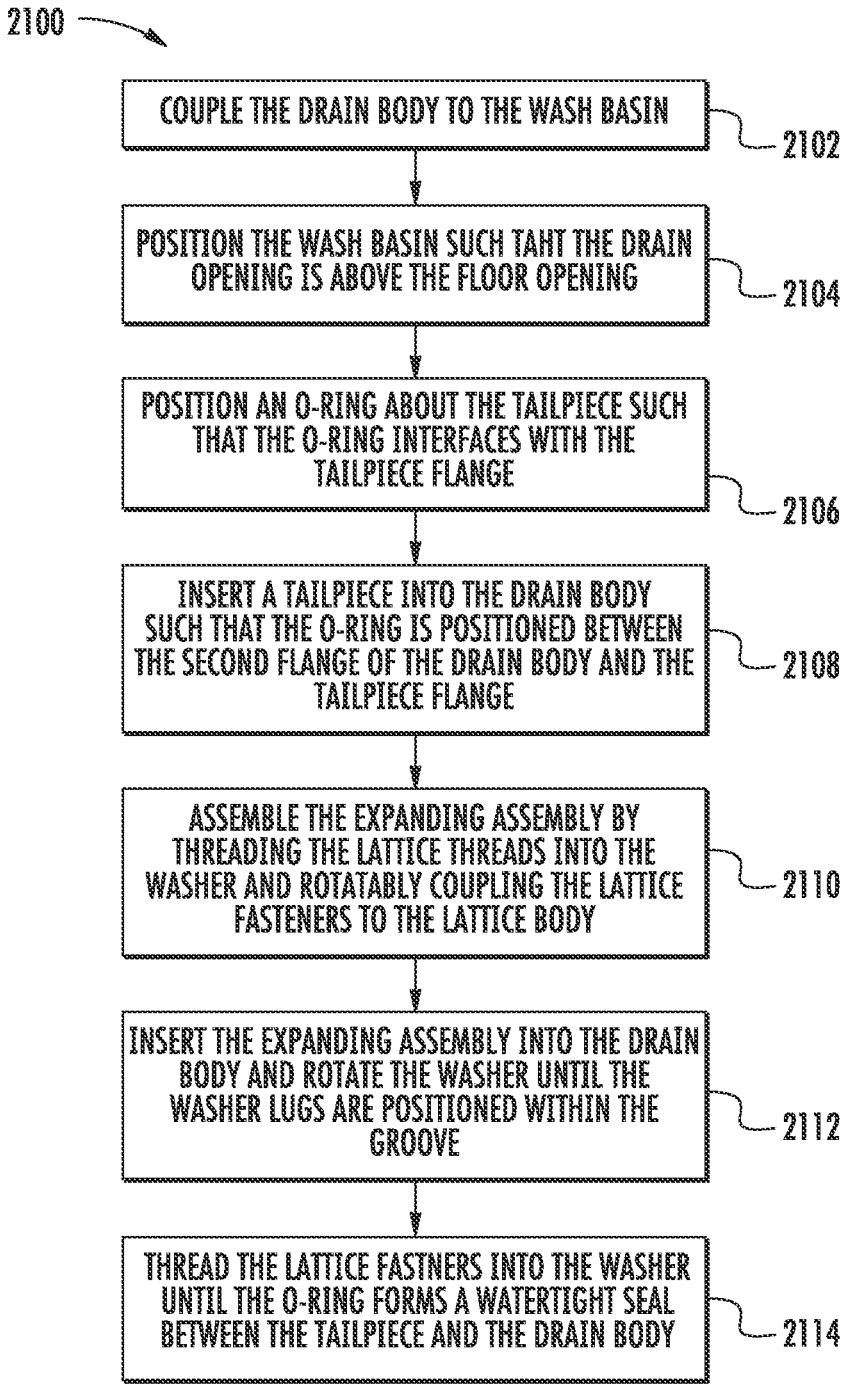
FIG. 21 shows a method of installing the easy drain installation assembly of FIG. 16, according to an exemplary embodiment.

Referring to FIGS. 19, 20 and 21, an exploded, cross-sectional view of a partially installed easy drain installation assembly 1600 is shown along with a method 2100 for installing the easy drain installation assembly 1600. As shown in FIG. 19, the easy drain installation assembly 1600 may further include a first sealing member 602, a second sealing member 604, a deck washer 606, and a deck nut 608. When the easy drain installation assembly 1600 is installed within a wash basin 100, the first sealing member 602 may be centered on the center axis Z and positioned between the first flange 314 and the top basin surface 110 such that the first sealing member 602 is pinched (e.g., clamped, etc.) between the first flange 314 and the top basin surface 110 such that a watertight seal is formed. In some embodiments, the first sealing member 602 is formed of a compliant material such that the first sealing member 602 deforms when clamped.

When the easy drain installation assembly 1600 is installed within a wash basin 100, the second sealing member 604 may be centered on the center axis Z and positioned between the deck nut 608 and the bottom basin surface 120 such that the second sealing member 604 is pinched between the deck nut 608 and the bottom basin surface 120, the second sealing member 604 cooperating with the bottom basin surface 120 to form a watertight seal. In some embodiments, the second sealing member 604 is formed of a compliant material such that the second sealing member 604 deforms when clamped. To facilitate clamping of the second sealing member 604, a deck washer 606 may be interposed between the deck nut 608 and the second sealing member 604, the deck washer 606 serving to distribute the force applied by the deck nut 608 as the deck nut 608 is coupled to the drain body 1620. The deck nut 608 is configured to form a threaded connection with the drain body 1620 about the first body threads 330.

At 2102, the drain body 1620 is coupled to (e.g., removably coupled to, threadingly coupled to, etc.) the wash basin 100 within the drain opening 130. Specifically, the drain body 1620 is inserted into the drain opening 130 such that the first flange 314 interfaces with the first sealing member 602, and the first sealing member 602 interfaces with the top basin surface 110. The first flange 314 prevents the drain body 1620 from sliding through the drain opening 130 and into the floor opening 107. Then, from the underside of the wash basin 100, the second sealing member 604 is disposed on the drain body 1620 proximate to the first body threads 330, the second sealing member 604 interfacing with the bottom basin surface 120. The deck washer 606 is slid over the drain body 1620 and interfaces with the second sealing member 604. The deck nut 608 is coupled to the drain body 1620 (e.g., threadingly coupled to the first body threads 330). The deck nut 608 is tightened until the first sealing member 602 and the second sealing member 604 are compressed, holding the drain body 1620 in place relative to the wash basin 100 and forming a watertight seal between the wash basin 100 and the drain body 1620.

At 2104, the wash basin 100 is positioned such that the drain opening 130 is centered over (e.g., concentric about) the floor opening 107.

At 2106, the O-ring 610, is inserted over the tailpiece 240 until it interfaces with the tailpiece flange 614.

At 2108, the tailpiece 240 is inserted into the drain body 1620 from within the wash basin 100. The tailpiece 240 is configured to slide through the drain body 1620 until the O-ring 610 interfaces with the second flange 350. In some embodiments, the tailpiece flange 614 interfaces with the second flange 350. The tailpiece flange 614 defines a tail flange diameter, the tail flange diameter greater than the fourth diameter $D_4$ and less than the fifth diameter $D_5$. The second flange 350 is configured to prevent the tailpiece 240 from sliding all the way through the drain body 1620 and falling out of the drain body 1620 in a direction generally along the center axis Z.

At 2110, the expanding assembly 1630 is assembled. The lattice fasteners 505 may be threaded into the washer 1804 (e.g., the apertures 565, 567, 569 of the washer projections 560, 562, 564). In some embodiments, it may be desirable to rotatably couple the lattice fasteners 505 to the lattice body 1802 after the lattice fasteners 505 are threaded to the washer 1804. For example, a magnet may be positioned within each of the first cavity 536, second cavity 538 and third cavity 540 such that the lattice fasteners 505 will remain coupled to the lattice body 1802 while the expanding assembly 1630 is inserted into the drain body 1620, but allows the lattice fasteners 505 to rotate relative to the lattice body 1802 when the lattice fasteners are tightened to couple the expanding assembly 1630 to the drain body 1620.

At 2112, the expanding assembly 1630 is inserted into the drain body 1620. To insert the expanding assembly 1630, the washer lugs 1875 are aligned with the guidance channels 1700. The washer lugs 1875 then slide through the drain body 1620 along the guidance channels 1700 until the washer lugs 1875 interface with the third groove surface 366. Once the washer lugs 1875 are resting on the third groove surface 366, the washer 1804 is rotated about the center axis Z relative to the drain body 1620 until the washer lugs 1875 are positioned between the first groove surface 362 and the third groove surface 366. In some embodiments, the second groove surface 364 is ramped such that the second groove surface 364 effectively reduces diameter and the washer lugs 1875 get wedged within the groove 360 between the first groove surface 362 and the third groove surface 366.

In some embodiments, the lattice body 1802 may be positioned within the drain body 1620 prior to inserting the washer 1804 into the drain body 1620. Thus, the washer 1804 may be rotated until the apertures 565, 567, 569 are aligned with the first cavity 536, the second cavity 538, and the third cavity 540. Then, once aligned, the washer 1804 and the lattice body 1802 may be rotated simultaneously until the washer lugs 1875 are positioned between the first groove surface 362 and the third groove surface 366.

At 2114, the lattice fasteners 505 are threaded into the washer 1804 until the second lattice surface 516 interfaces with the tailpiece flange 614 and the washer lugs 1875 interface with the first groove surface 362. The first groove surface 362 applies a force to the washer 1804, which is transferred to the lattice body 1802 through the lattice fasteners 1505. The lattice body 1802 applies a force to the tailpiece flange 614, compressing the O-ring 610 between the tailpiece flange 614 and the second flange 350, forming a watertight seal between the drain body 1620 and the tailpiece 240. In some embodiments, the desired amount of compression on the O-ring 610 is achieved when each of the first fastener 506, the second fastener 508, and the third fastener 510 are torqued to a predetermined torque. In some embodiments, each of the lattice fasteners 505 includes a fastener head defining a diameter greater than the size of the first, second, and third apertures 565, 567,569. The lattice fasteners 505 may be sized such that when the fastener heads of the lattice fasteners 505 interface with the first washer surface 552, the O-ring 610 is under the desired amount of compression and a watertight seal is formed between the tailpiece 240 and the drain body 1620.

Figure 22:
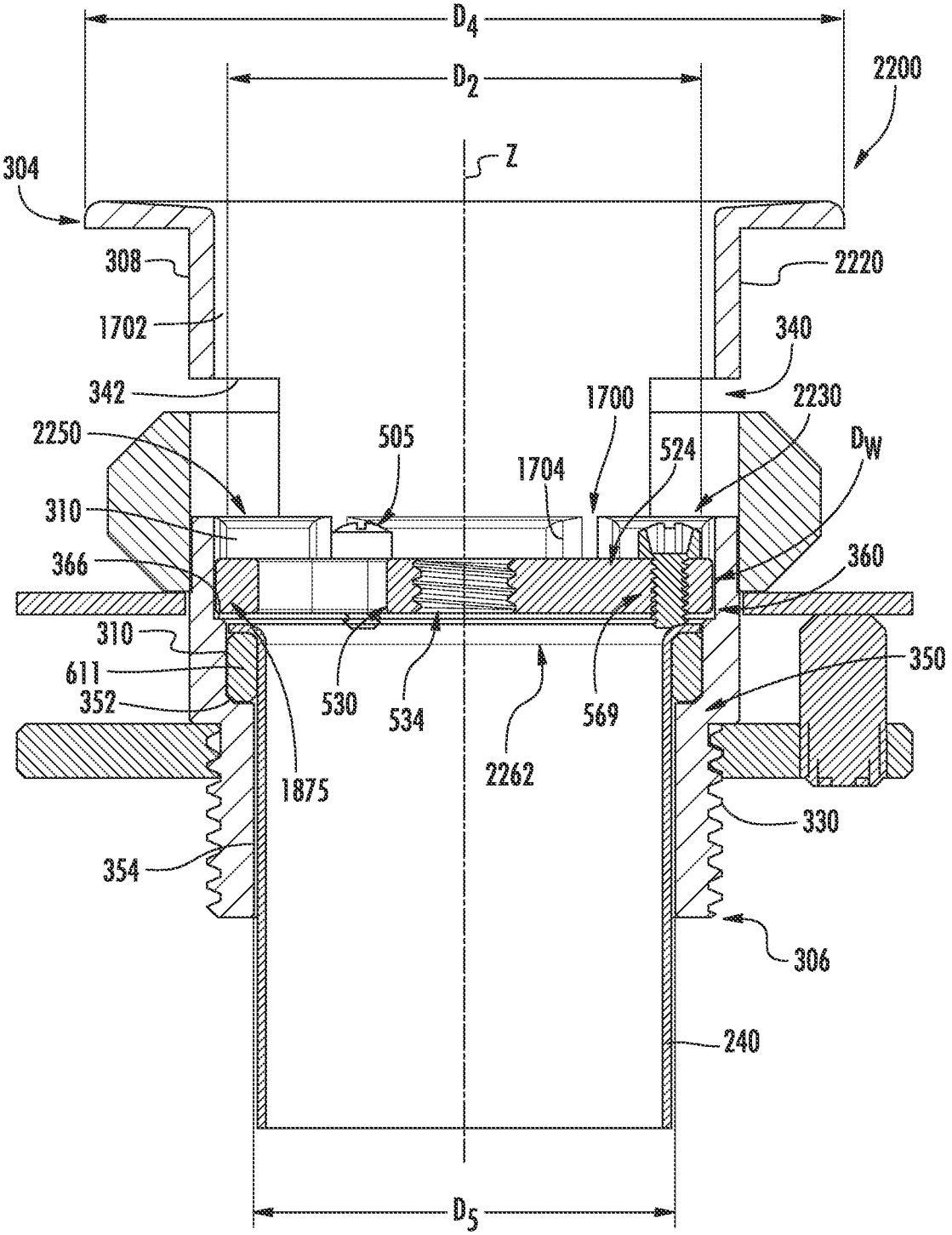
FIG. 22 shows a side, cross-sectional view of an easy drain installation assembly according to another example embodiment.
Figure 23:
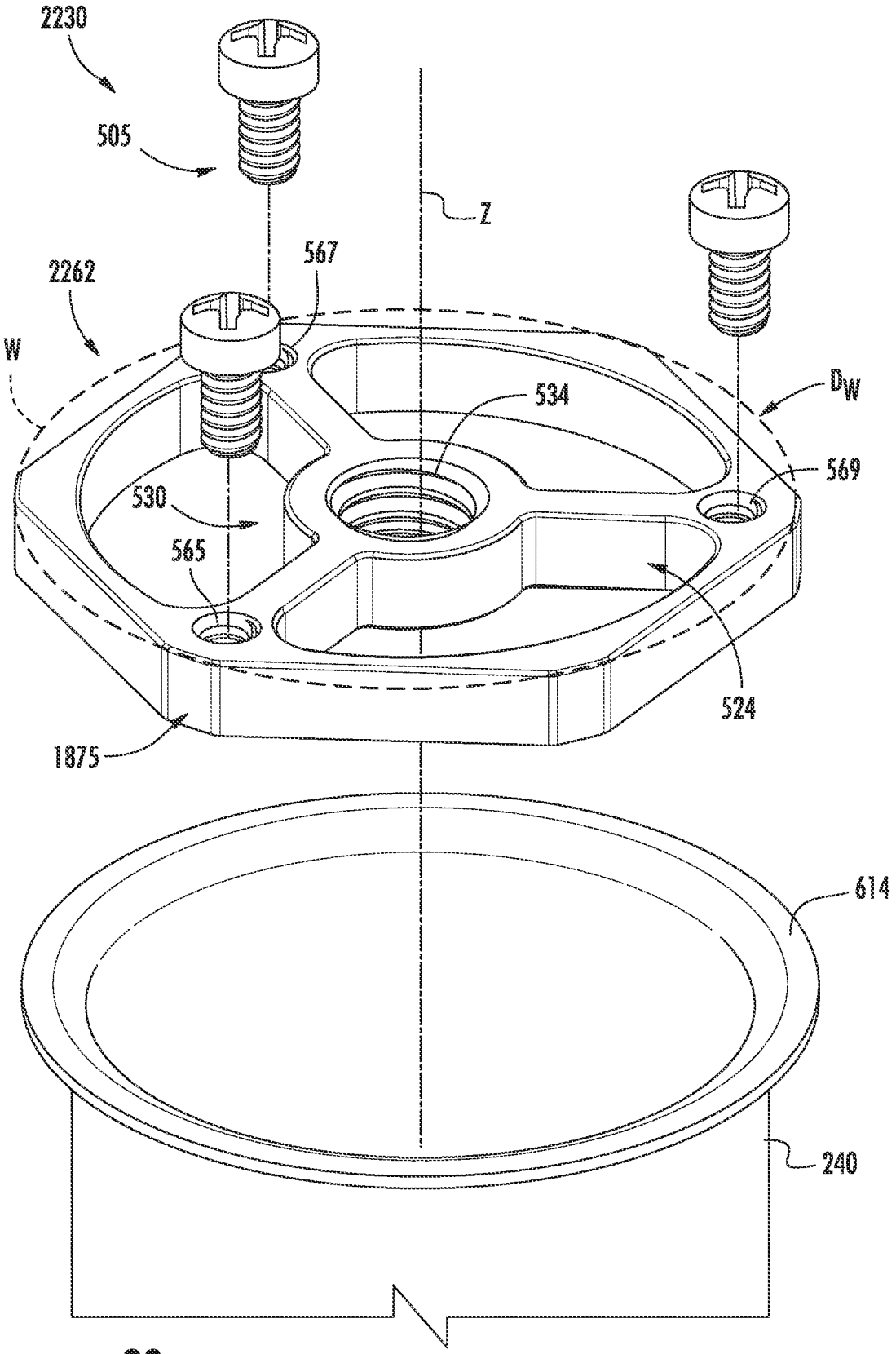
FIG. 23 shows an exploded top view of a portion of the easy drain installation assembly of FIG. 22.

Referring now to FIGS. 22 and 23, an easy drain installation assembly 2200 is shown, according to an example embodiment. The easy drain installation assembly 2200 is similar to the easy drain installation assembly 1600 of FIGS. 16-21.

Accordingly, like numbering is used to designate like parts between the easy drain installation assembly 2200 and the easy drain installation assembly 1600. A difference between the easy drain installation assembly 2200 and the easy drain installation assembly 1600 is that the lattice fasteners 505 of the easy drain installation assembly 2200 interface with the tailpiece flange 612 when the lattice body is coupled to the drain body.

The easy drain installation assembly 2200 includes a drain body 2220, and an expanding assembly 2230. The expanding assembly 2230 is configured to be received within and coupled to the drain body 2220. In some embodiments, the easy drain installation assembly 2200 includes the drain body 2220, the expanding assembly 2230, and a toe tap (e.g., the toe tap 210). The toe tap 210 is configured to be disposed within and received by the drain body 2220. When the expanding assembly 2230 is disposed within the drain body 2220, the toe tap 210 may be received within the drain body 2220 and removably coupled to (e.g., threadably coupled to, etc.) the expanding assembly 2230. A portion of the toe tap 210 extends out of the drain body 2220. The drain body 2220 and the toe tap 210 are configured to cooperate to selectively prevent a flow of water, such as from the wash basin 100, through the drain body 2220.

The drain body 2220 includes a generally annular first body 302 having a first upper end 304, a first lower end 306, a first outer surface 308, and a first inner surface 310. The first outer surface 308 and the first inner surface 310 may be concentric about the center axis Z. The first inner surface 310 defines a first inner surface diameter $D_2$.

The drain body 2220 further includes a generally annular flange, shown as a first flange 314 extending laterally outwardly from (e.g., orthogonal to) the first outer surface 308 proximate to the first upper end 304. The first flange 314 defines the fourth diameter $D_4$.

The drain body 1620 further includes a generally annular flange, shown as a second flange 350, disposed within the first inner surface 310 and extending laterally away from the first inner surface 310, toward the center axis Z. As shown, the second flange 350 may be positioned proximate to the first lower end 306. The second flange 350 may be manufactured from metal, plastic, or similar materials. The second flange 350 may be structurally integrated with the drain body 2220, such as by die-casting, injection molding, 3D printing, or similar manufacturing processes. In some embodiments, the second flange 350 is manufactured separately from the drain body 2220 and later coupled to the drain body 1620.

The second flange 350 includes a frusto-conical surface, shown as a top second flange surface 352, and a generally annular inner second flange surface 354. The top second flange surface 352 is contiguous with the first inner surface 310, and the inner second flange surface 354 is contiguous with the top second flange surface 352. The second flange 350, and more specifically, the inner second flange surface 354, may define the fifth diameter $D_5$, the fifth diameter $D_5$ being less than the second diameter $D_2$. Generally speaking, second flange 350 is configured to prevent the tailpiece 240 from sliding entirely through the drain body 2220. Specifically, the second flange 350 prevents axial movement of the tailpiece 240 in a direction generally away from the first flange 314. In some embodiments, the top second flange surface 352 may extend away from the first inner surface 310 in a direction both toward the center axis Z and away from the first flange 314, providing a ramped surface between the first inner surface 310 and the inner second flange surface 354. The tapering of the top second flange surface 352 may facilitate forming a seal between the tailpiece 240 and the second flange 350. For example, a sealing member 611 (e.g., O-ring, head seal, hydraulic seal), may be positioned between the tailpiece 240 and the second flange 350, the top second flange surface 352 acting as a wedge to bias the sealing member 611 toward the center axis Z and into the tailpiece 240 when the tailpiece 240 is biased into the second flange 350 by the expanding assembly 2230.

The drain body 1620 may further include overflow openings 340. The overflow openings extend through the drain body 2220 such that a flow of water may exit the drain body 2220 through the overflow openings 340. Each of the overflow openings 340 is defined by a generally rectangular surface, shown as an overflow opening surface 342.

The drain body 1620 further includes a generally annular flange, shown as a third flange 2250, extending radially inward from the drain body 2220 and toward the center axis Z. The third flange 2250 is positioned between the upper end 304 and the second flange 350. The third flange 2250 may be manufactured from metal, plastic, or similar materials. The third flange 350 may be structurally integrated with the drain body 2220, such as is possible though die-casting, injection molding, 3D printing, or similar manufacturing processes. In some embodiments, the third flange 2250 is manufactured separately from the drain body 2220 and later coupled to the drain body 2220. The third flange 2250 includes a portion of the inner surface 310, and thus defines the second diameter $D_2$.

A groove 360 extends circumferentially about the drain body 2220 between the third flange 2250 and the second flange 350. The groove 360 defines a diameter greater than both the fifth diameter $D_5$ and the second diameter $D_2$. In some embodiments, a portion of the groove 360 is defined by the third flange 2250.

The groove 360 is configured to receive a portion of the expanding assembly 2230 and prevent the expanding assembly 2230 from moving axially away from the drain body 2220 in a direction generally along the center axis Z.

Extending through the third flange 2250 and contiguous with the groove 360 is a guidance channel 1700 (e.g., cut-out, etc.). The guidance channel 1700 may be formed within the drain body 1620 by thinning a portion of the material of the third flange 2250.

The guidance channel 1700 is configured to receive a portion of the expanding assembly 2230. Generally speaking, a portion of the expanding assembly 2230 defines a diameter greater than the second diameter $D_2$. To facilitate the insertion of the expanding assembly 2230 into the drain body 2220, the drain body 2220 may include the guidance channel 1700. As shown in FIG. 22, the drain body 2220 includes six guidance channels 1700. However, in some embodiments, the drain body 2220 includes fewer (e.g., 1) or more (e.g., 8) guidance channels 1700. The guidance channel 1700 defines a guide surface 1702 and a pair of side guide surfaces 1704. The guide surface 1702 is radially positioned between the first inner surface 310 and the first outer surface 308 relative to the central axis Z. In some embodiments, such as when the drain body 2220 includes three guidance channels 1700, the guide surface 1702 of each of the guidance channels 1700 cooperate to define a diameter greater than the fifth diameter $D_5$ and the second diameter $D_2$. The side guide surface 1704 may be contiguous with the guide surface 1702 and with the first inner surface 310. When the expanding assembly 2230 is positioned within the guidance channels 1700, the side guide surfaces 1704 prevent rotation of the expanding assembly 2230 about the center axis Z relative to the drain body 2220.

As shown in FIG. 16 with respect to the drain body 1620, the guidance channel 1700 is formed within the first inner surface 310 and extends between the groove 360 and the first flange 314. A difference between the drain body 1620 and the drain body 2220 is that the first inner surface 310 of the drain body 2220 between the third flange 2250 and the first flange 314 is removed to match the diameter of the guide surface 1702 and the groove 360. This allows the installer to position the expanding assembly 2230 within the drain body 2220 before turning the expanding assembly 2230 into the guidance channels 1700 and positioning the expanding assembly 2230 at least partially within the groove 360.

Contrast that to the drain body 1620, where the expanding assembly 1630 is matched with the guidance channels 1700 before being positioned within the drain body 1620.

Referring now to FIG. 23, the expanding assembly 2230 is shown according to an example embodiment. The expanding assembly 2230 includes the lattice fasteners 505 and a lattice body 2262. The lattice body 2262 is similar to the lattice body 1802. A difference between the lattice body 2262 and the lattice body 1802 is that the lattice body 2262 includes a plurality of threaded apertures. Specifically, the lattice body 2262 is similar to a combination of the lattice body 1802 and the washer 1804. The lattice body 2262 includes the coupling body 530 and the support structures 521, 522, 523 of the lattice body 1802 and the apertures 565, 567, 569 and the lugs 1870, 1872, 1874 of the washer 1804. Accordingly, like numbering is used to designate like parts between the lattice body 2262 and the lattice body 1802 and the washer 1804 of the easy drain installation assembly 1600.

The expanding assembly 2230 includes a lattice body 2262 and the lattice fasteners 505. The lattice fasteners 505 are threaded into the lattice body 2262 and rest on the tailpiece flange 614. As the lattice fasteners 505 are tightened, the lattice body 2262 is biased toward the third flange 2250 and the tailpiece flange 612 is biased toward the second flange 350.

When the expanding assembly 2230 is positioned within the drain body 2220, the lattice body 2262 slides freely between the first flange 314 and the third flange 2250. Once the expanding assembly 2230 interfaces with the third flange 2250, the expanding assembly 2230 is rotated about the central axis Z until the expanding assembly 2230 is received by the guidance channels 1700. The expanding assembly 2230 passes through the guidance channel 1700 and toward the groove 360, coming to rest on the third groove surface 366. The lattice body 2262 is then rotated such that the lugs 1870 interface with the third flange 2250 when the lattice fasteners 505 are tightened. This force compresses the tailpiece flange 612 between the lattice body 2262 and the second flange 350, retaining the tailpiece 240 within the drain body 2220 and preventing translational and axial movement of the tailpiece 240 along the center axis Z. In some embodiments, a sealing member 611, such as a gasket or an O-ring, may be positioned between the tailpiece flange 614 and the second flange 350 such that the force applied by the lattice fasteners 505 compresses the sealing member 611 and forms a substantially watertight seal between the tailpiece 240 and the drain body 2220.

Extending through the lattice body 2262 are a plurality of openings configured to allow a flow of water to pass through the drain body 2220, and likewise the tailpiece 240. The lattice body 2262 further defines a support structure 524. The support structures 524 are configured to allow a flow of water to pass through the drain body 2220, such as a flow of water from the wash basin 100.

The support structures 524 cooperate proximate to the center axis Z to support a generally annular coupling body 530. The coupling body 530 is concentric about the center axis Z. The coupling body 530 includes a coupling body orifice 534 concentric about the center axis Z and configured to accept a fastener, such as may be included in a drain stopper or the toe tap 210. In some embodiments, the coupling body orifice 534 interfaces with the toe tap 210 such that the toe tap 210 may be removably coupled to the lattice body 2262. In some embodiments, the coupling body orifice 534 is not required during the installation of the toe tap 210, but gives an installer of the easy drain installation assembly 2200 options as to which type of stopper or toe tap 210 they may prefer to use.

The lattice body 2262 further includes a plurality of apertures 565 extending through the support structures 524. The first aperture 565, the second aperture 567, and the third aperture 569 may be positioned rotationally symmetrically about the lattice body 2262 such that the first aperture 565 and the second aperture 567 are rotationally separated by one-hundred-and-twenty (120) rotational degrees. In some embodiments, the lattice body 2262 does not include the third aperture 569, and the first aperture 565 and the second aperture 567 are separated by one-hundred-and-eighty (180) rotational degrees.

The lattice body 2262 further includes a plurality of lugs 1875 extending radially away from the lattice body 2262. In some embodiments, the lattice body 2262 has a regular hexagonal shape, where the corners of the hexagon are the plurality of lugs 1875. In some embodiments, the lattice body 2262 defines a regular octagonal shape, wherein the corners of the octagon are the plurality of lugs. In some embodiments, similar to the washer 1804, the lattice body 2262 defines a substantially annular body having a plurality of lugs that extend radially away from the lattice body 2262 in a direction away from the central axis Z.

The lugs 1875 are configured to be received within the groove 360 such that the lattice body 2262 may rotate within the groove 360 about the center axis Z relative to the drain body 2220. The lugs 1875 define a lug diameter $D_W$, shown by the dotted line W. The lug diameter $D_w$ is greater than the second diameter $D_2$. The lug diameter $D_w$ may be slightly smaller than the diameter of the groove 360 such that the lugs 1875 form a slip fit with the groove 360.

Figure 24:
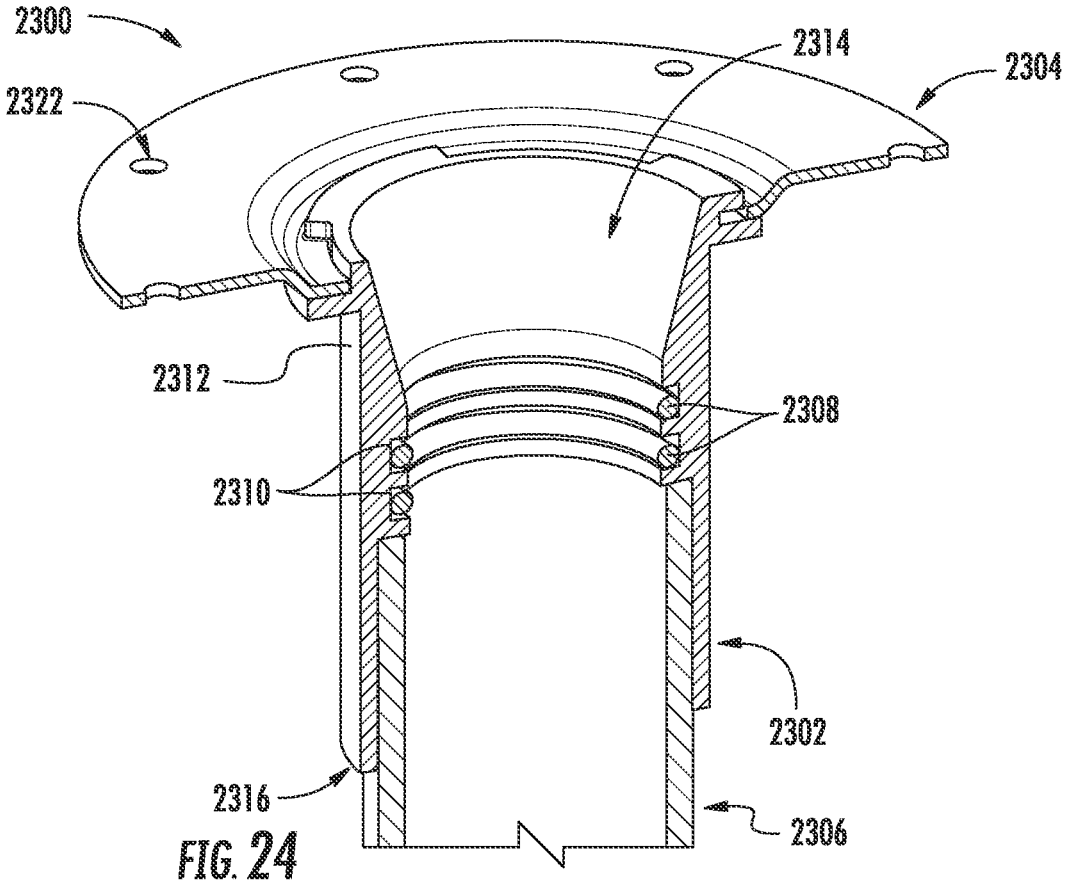
FIG. 24 shows a perspective, cross-sectional view of a floor drain assembly according to an example embodiment.

Referring now to FIG. 24, a perspective, cross-sectional view of a floor drain assembly 2300 is shown, according to an example embodiment. The floor drain assembly 2300 includes a drain coupling 2302 and a floor coupling 2304. The drain coupling 2302 is configured for coupling to drainage plumbing 2306. For example, the drainage plumbing 2306 may be a PVC pipe positioned below a subfloor. The drain coupling 2302 may be coupled to the drainage plumbing 2306 using PVC/CPVC cement, adhesives, epoxy, fasteners, welding, and the like. Positioned within the drain coupling 2302 are a pair of sealing members 2308 positioned within a pair of grooves 2310 formed within the inner surface 2312 of the drain coupling 2302. At an input of the drain coupling 2302, the inner surface 2312 tappers from a first cross-sectional area to a second cross-sectional area proximate to the pair of grooves 2310, the first cross-sectional area being greater than the second cross-sectional area. Proximate to the output 2316 of the drain coupling 2302, the drain coupling 2302 receives the drainage plumbing 2306.

The drain coupling 2302 is configured to receive the tailpiece 240 and form a sealing engagement between the drain coupling 2302 and the tailpiece 240. In some embodiments, the tailpiece 240 engages with the pair of sealing members 2308 to form a substantially water-tight axial seal between the tailpiece 240 and the drain coupling 2302. The tapering of the inner surface 2312 provides a guide for the installer when inserting the tailpiece 240 into the drain coupling 2302 via the inlet 2314.

Figure 25:
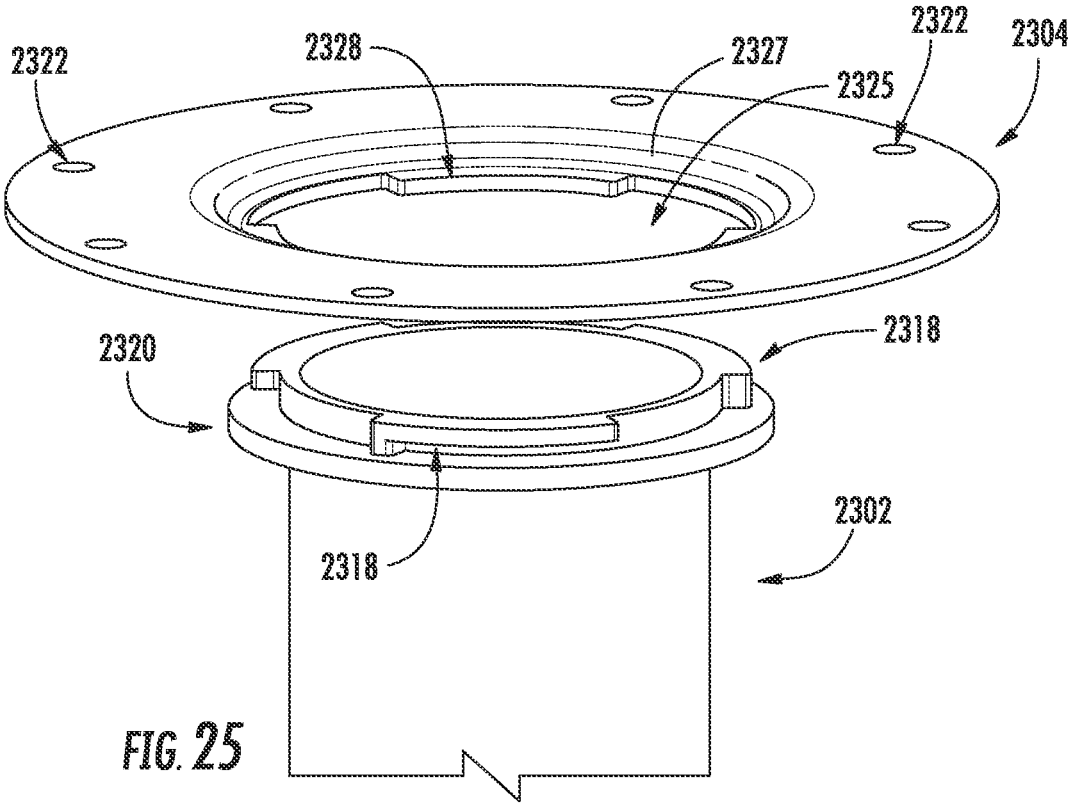
FIG. 25 shows an exploded top view of a portion of the floor drain assembly of FIG. 24.

Turning now to FIG. 25, the drain coupling 2302 is shown as including a plurality of channels 2318 positioned proximate to the inlet 2314 and extending circumferentially about the inlet 2314. The channels are configured to receive a portion of the floor coupling 2304 to facilitate coupling between the drain coupling 2302 and the floor coupling 2304. As shown, the drain coupling 2302 includes four channels 2318 extending circumferentially about the inlet 2314 and positioned radially equidistant from one another. In some embodiments, the drain coupling 2302 includes a different number of channels 2318, such as three or five.

The drain coupling 2302 further includes a drain coupling flange 2320 extending radially away from the drain coupling 2302 in a direction away from the central axis Z. The drain coupling flange 2320 cooperates to define a portion of the plurality of channels 2318. The drain coupling flange 2320 facilitates the positioning of the floor coupling 2304 to prevent the floor coupling 2304 from sliding axially along the drain coupling 2302.

The floor coupling 2304 is configured for coupling to a floor, such as a wooden subfloor or a floor that includes a rubber membrane (e.g., hot mop). The floor coupling 2304 includes a plurality of apertures 2322 positioned radially about the floor coupling 2304. The plurality of aperture 2322 are configured to receive fasteners for coupling the floor coupling 2304 to a floor. Extending through the center of the floor coupling 2304 is an opening 2325 configured to receive the inlet 2314 of the drain coupling 2302. The floor coupling 2304 incudes a tapered offset 2327 that extends toward the opening 2325 and is configured to position the opening 2325 below the subfloor when the floor coupling 2304 is coupled to the drain coupling 2302. Extending radially into the opening 2325 in a direction toward the central axis Z are a plurality of fins 2328 extending circumferentially about the opening 2325 and configured to be received within the plurality of channels 2318 of the drain coupling 2302. To couple the floor coupling 2304 to the drain coupling 2302, the floor coupling 2304 is positioned over the drain coupling until the opening 2325 receives the inlet 2314 and the fins 2328 engage the drain coupling flange 2320, and then the floor coupling 2304 is twisted to slide the plurality of fins 2328 into the plurality of channels 2318.

In some embodiments, the drain coupling 2302 is first coupled to the drainage plumbing 2306, and then the floor coupling 2304 is coupled with the drain coupling 2302 afterwards. In some embodiments, the floor coupling 2304 is coupled to the drain coupling 2302, and then the drain coupling 2302 is coupled to the drainage plumbing 2306 afterwards. After all three of the drain coupling 2302, the floor coupling 2304, and the drainage plumbing 2306 are coupled together, fasteners are inserted through the plurality of apertures 2322 and the floor coupling 2304 is coupled to the floor.

While it is disclosed above that the drain coupling 2302 and the floor coupling 2304 are compatible with the tailpiece 240, it should be understood that similar variations of the floor drain assembly 2300 are also compatible with the tailpiece 240, and thus compatible with the easy drain installation assembly 200 (e.g., easy drain installation assembly 800, easy drain installation assembly 1600, easy drain installation assembly 2200).

Figure 26:
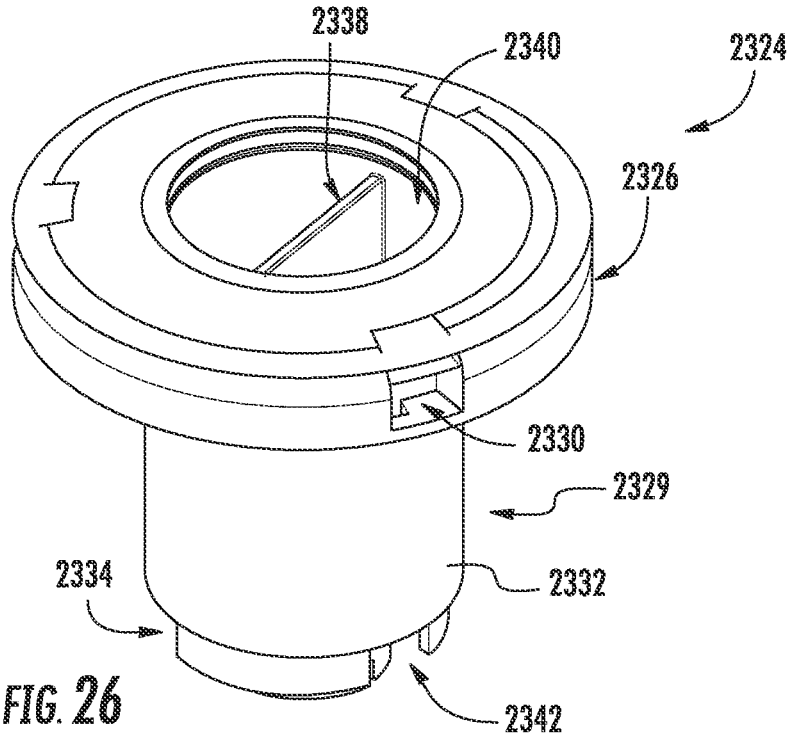
FIG. 26 shows a perspective view of an installation tool according to an example embodiment.
Figure 27:
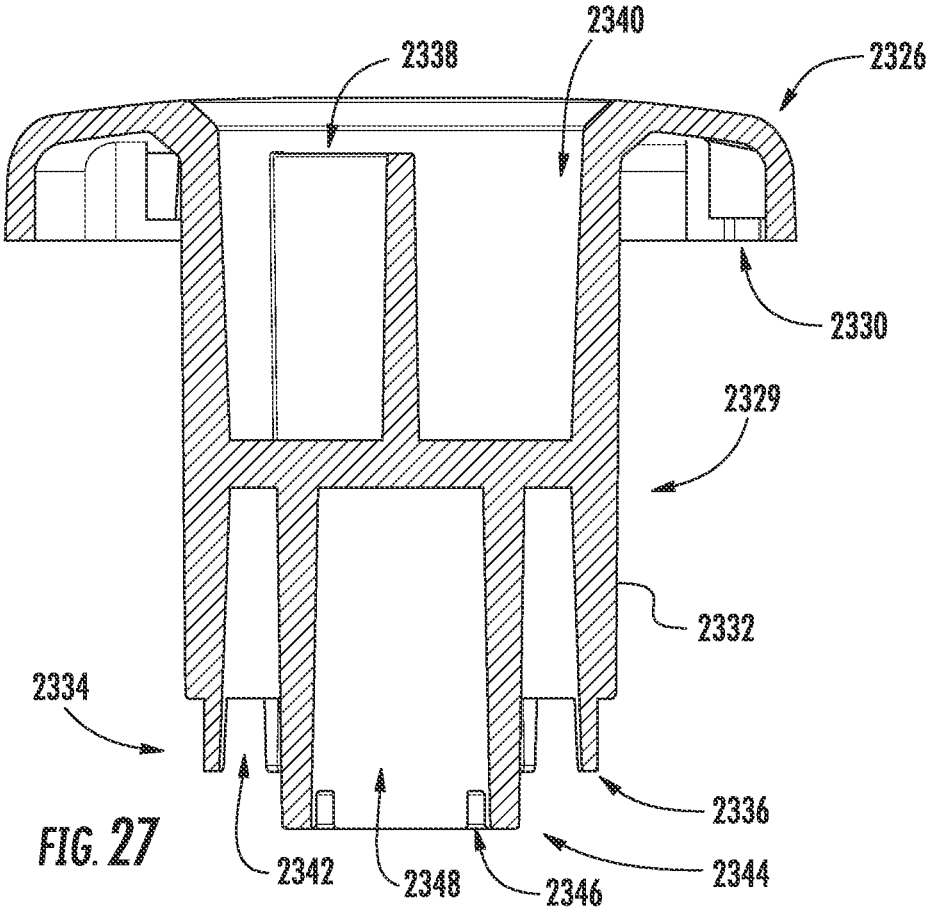
FIG. 27 shows a cross-sectional view of the installation tool of FIG. 26.

Referring now to FIGS. 26 and 27, an installation tool 2324 is shown, according to an example embodiment. The installation tool 2324 is configured to facilitate the installation of the drain body 2220 and the lattice body 2262. The installation tool 2324 is also configured for use to leak test the drain coupling 2302, and more specifically the pair of sealing members 2308. The installation tool 2324 includes a mushroom-topped head 2326 having a cylindrical body 2329 extending away from the head 2326. Positioned circumferentially about the head 2326 are a plurality of circumferentially extending tabs 2330 substantially similar to the plurality of fins 2328 in that the tabs 2330 are configured to be received within the plurality of channels 2318. When the installation tool 2324 is coupled to the drain coupling 2302, the cylindrical body 2329 extending into the inlet 2314 and an outer tool surface 2332 of the cylindrical body 2329 engages the pair of sealing members 2308 and cooperates to form a substantially watertight axial seal between the drain coupling 2302 and the installation tool 2324. Thus, an installer may leak-test the drain coupling 2302 before installation the wash basin 100 and the tailpiece 240. In some embodiments, a diameter of the outer tool surface 2332 is substantially similar to the diameter of the tailpiece 240. In some embodiments, the outer tool surface 2332 tapers from a larger cross-sectional area proximate to the head 2326 to a smaller cross-sectional area proximate to an end 2334 of the installation tool 2324 opposite to the head 2326.

Extending axially away from the outer tool surface 2332 proximate to the end 2334 is a first set of fingers 2336. The first set of fingers 2336 is configured to engaging a portion of an easy drain installation assembly (e.g., the easy drain installation assembly 200, the easy drain installation assembly 900, the easy drain installation assembly 1600, the easy drain installation assembly 2200). For example, the first set of fingers 2336 may engage with a lattice body (e.g., the lattice body 502, the lattice body 1802, the lattice body 2262), a washer (e.g., the washer 504, the washer 1804), a drain body (e.g., the drain body 220, the drain body 960, the drain body 1620, the drain body 2220), a body nut 965, a toe tap (e.g., the toe tap 210), or a similar structure. When the installation tool 2324 is extended into the drain body, the installer my turn the installation tool 2324 using a handle 2338 positioned in a cavity 2340 in the head 2326. The installer may turn the installation tool 2324 in any number of degrees about the central axis Z. As shown, each of the fingers of the first set of fingers 2336 may be separated by a first gap 2342 such that a portion of the easy drain installation assembly may be received within the first gap 2342.

Extending axially away from the end 2334 of the cylindrical body 2329 is a second set of fingers 2344 substantially similar to the first set of fingers 2336. A difference between the second set of fingers 2344 and the first set of fingers 2336 is that the second set of fingers 2344 define a smaller diameter (e.g., cross-sectional area) than the first set of fingers 2336. The second set of fingers 2344 is configured to engaging a portion of an easy drain installation assembly (e.g., the easy drain installation assembly 200, the easy drain installation assembly 900, the easy drain installation assembly 1600, the easy drain installation assembly 2200). For example, the first set of fingers 2336 may engage with a lattice body (e.g., the lattice body 502, the lattice body 1802, the lattice body 2262), a washer (e.g., the washer 504, the washer 1804), a drain body (e.g., the drain body 220, the drain body 960, the drain body 1620, the drain body 2220), a body nut 965, a toe tap (e.g., the toe tap 210), or a similar structure. When the installation tool 2324 is extended into the drain body, the installer my turn the installation tool 2324 using the handle 2338. The installer may turn the installation tool 2324 in any number of degrees about the central axis Z. As shown, each of the fingers of the second set of fingers 2344 may be separated by a second gap 2346 such that a portion of the easy drain installation assembly may be received within the second gap 2346. Extending along the central axis Z may be an extended chamber 2348 configured to receive a portion of the east drain installation assembly such that the fingers (e.g., the first set of fingers

2336, the second set of fingers 2344) may engage a different portion of the easy drain installation assembly.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, and/or illustrations of possible embodiments (and such terms are not intended to connote that such embodiments are necessarily extraordinary or superlative examples).

The term "coupled," as used herein, means the joining of two members directly or indirectly to one another. Such joining may be stationary (e.g., permanent or fixed) or moveable (e.g., removable or releasable). Such joining may be achieved with the two members coupled to each other, with the two members coupled with a separate intervening member and any additional intermediate members coupled with one another, or with the two members coupled together with an intervening member that is integrally formed as a single unitary body with one of the two members. Such members may be coupled mechanically, electrically, and/or fluidly.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the shelf assembly as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, the position of elements may be reversed or otherwise varied, and the nature or number of discrete elements or positions may be altered or varied. Any element disclosed in one embodiment may be incorporated or utilized with any other embodiment disclosed herein. Although one example of an element that can be incorporated or utilized in another embodiment has been described above, it should be appreciated that other elements of the various embodiments may be incorporated or utilized with any of the other embodiments disclosed herein.

Other substitutions, modifications, changes and omissions may also be made in the design, operating conditions and arrangement of the various exemplary embodiments without departing from the scope of the present invention. For example, any element (e.g., arm, shelf member, fastener, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

It is important to note that any element disclosed in one embodiment may be incorporated or utilized with any other embodiment disclosed herein. For example, the expanding assembly 2230 may be incorporated in the easy drain installation assembly 1600. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A drain assembly comprising:

a drain body defining an axis, the drain body comprising:

a first flange extending away from an inner surface of the drain body toward the axis; and a second flange extending away from the inner surface of the drain body toward the axis; and an expanding assembly positionable within the drain body between the first flange and the second flange, the expanding assembly comprising:

a lattice body positionable between the first flange and the second flange, a portion of the lattice body defining an aperture extending therethrough; and a fastener adjustably coupled to the lattice body at the aperture, the fastener configured to be adjusted relative to the lattice body such that the expanding assembly applies an axial force to the first flange and the second flange.

2. The drain assembly of claim 1, wherein the lattice body further comprises a support structure extending toward the axis, the support structure having body for receiving a toe tap centered on the axis.

3. The drain assembly of claim 1, further comprising a tailpiece configured to be received by the drain body, the tailpiece comprising a tailpiece flange configured to interface with the second flange, the second flange preventing axial movement of the tailpiece in a direction away from a groove of the drain body along the axis when the tailpiece is positioned within the drain body.

4. The drain assembly of claim 3, further comprising a sealing member, the sealing member positioned about the tailpiece between the second flange and the tailpiece flange, the sealing member configured to sealingly engage between the tailpiece and the drain body when the expanding assembly applies an axial force to the first flange and the second flange.

5. The drain assembly of claim 1, wherein the drain body further defines an outer surface, the drain body comprising a third flange extending away from the outer surface proximate an end of the drain body.

6. The drain assembly of claim 1, wherein:

the first flange defines a first flange diameter; and the lattice body defines a plurality of lugs extending radially away from the lattice body, the plurality of lugs defining a lug diameter greater than the first flange diameter.

7. The drain assembly of claim 6, further comprising a plurality of guidance channels extending axially through the first flange, the plurality of guidance channels configured to receive the plurality of lugs.

8. The drain assembly of claim 6, further comprising a groove positioned between the first flange and the second flange, the groove configured to receive the plurality of lugs and configured to prevent translation of the lattice body in a direction toward the second flange along the axis.

9. A drain assembly comprising:

a drain body comprising an inner surface that defines a central axis, the inner surface further defining a body diameter, the drain body comprising:

a first flange extending inwardly toward the central axis and defining a first diameter less than the body diameter; and a second flange extending inwardly toward the central axis and defining a second diameter less than the first diameter;

an expanding assembly positioned between the first flange and the second flange, the expanding assembly configured to apply a force to both the first flange and the second flange in opposite directions; and a tailpiece comprising a tailpiece flange, the tailpiece flange defining a flange diameter greater than the second diameter and less than the first diameter, the tailpiece flange biased toward the second flange when the expanding assembly applies the force between the first flange and the second flange.

10. The drain assembly of claim 9, wherein the expanding assembly comprises:

a lattice body having a plurality of lugs;

an aperture extending through the lattice body; and a fastener threadingly coupled to the aperture and configured to extend through the aperture.

11. The drain assembly of claim 10, wherein the lattice body further comprises a support structure extending toward the central axis, the support structure having a body centered on the central axis, the body configured for receiving a toe tap.

12. The drain assembly of claim 9, wherein the first flange includes a plurality of guidance channels extending through the first flange and interrupting the first flange, the plurality of guidance channels configured to receive the expanding assembly.

13. The drain assembly of claim 12, wherein the drain body further comprises a groove positioned between the first flange and the second flange, the groove contiguous with the plurality of guidance channels.

14. A drain assembly comprising:

a drain body comprising:

an inner surface defining a groove that extends circumferentially about the drain body; and a body flange extending away from the inner surface of the drain body toward a central axis; and an expanding assembly positionable within the groove, the expanding assembly comprising:

a lattice body comprising a lug extending radially away from the lattice body in a direction generally away from the central axis, the lattice body defining an aperture therethrough proximate to the lug; and a fastener adjustably coupled to the lattice body and configured to extend through the aperture.

15. The drain assembly of claim 14, wherein the lattice body further comprises a support structure extending toward the central axis, the support structure having a body centered on the central axis, the body configured for receiving a toe tap.

16. The drain assembly of claim 14, further comprising a tailpiece configured to be positioned within the drain body, the tailpiece comprising a tailpiece flange positionable between the groove and the body flange, the body flange configured to prevent axial movement of the tailpiece in a direction generally away from the drain body along the central axis when the tailpiece flange is positioned within the drain body.

17. The drain assembly of claim 16, further comprising a sealing member positioned between the body flange and the tailpiece flange, the sealing member compressed between the tailpiece flange and the body flange when the expanding assembly is expanded, the sealing member configured to form a sealing engagement between the drain body and the tailpiece.

18. The drain assembly of claim 17, wherein the fastener extends through the aperture of the lattice body and engages the tailpiece flange to bias the tailpiece flange toward the body flange and compress the sealing member.

19. The drain assembly of claim 14, further comprising guidance channels contiguous with the groove and configured to receive the lug of the lattice body.

20. The drain assembly of claim 14, wherein the lattice body is rotatable within the groove about the central axis.

* * * * *